US009168439B2

(12) United States Patent
Motokawa

(10) Patent No.: US 9,168,439 B2
(45) **Date of Patent: *Oct. 27, 2015**

(54) GOLF CLUB HEAD

(71) Applicant: DUNLOP SPORTS CO. LTD., Kobe-shi, Hyogo (JP)

(72) Inventor: Yuki Motokawa, Kobe (JP)

(73) Assignee: DUNLOP SPORTS CO. LTD., Kobe-Shi (JP)

( * ) Notice: Subject to any disclaimer, the term of this patent is extended or adjusted under 35 U.S.C. 154(b) by 37 days.

This patent is subject to a terminal disclaimer.

(21) Appl. No.: 13/943,303

(22) Filed: Jul. 16, 2013

(65) Prior Publication Data

US 2014/0024475 A1 Jan. 23, 2014

(30) Foreign Application Priority Data

Jul. 17, 2012 (JP) ..... 2012-158619

(51) Int. Cl.

| | |
|---|---|
| ***A63B 53/06*** | (2015.01) |
| ***E01B 9/12*** | (2006.01) |
| ***A63B 59/00*** | (2015.01) |
| ***A63B 53/02*** | (2015.01) |
| ***A63B 53/04*** | (2015.01) |

(52) U.S. Cl.

CPC ..... *A63B 53/06* (2013.01); *A63B 53/02* (2013.01); *A63B 53/04* (2013.01); *A63B 53/0466* (2013.01); *A63B 59/0092* (2013.01); *A63B 53/047* (2013.01); *A63B 53/0487* (2013.01); *A63B 2053/0408* (2013.01); *A63B 2053/0433* (2013.01)

(58) Field of Classification Search

CPC .... A63B 53/06; A63B 53/02; A63B 53/0466; A63B 53/0487; A63B 2053/0408; A63B 59/0092; A63B 53/04; A63B 2053/0433; A63B 53/047

USPC ..... 473/324–350, 287–292, 256; 411/337–339, 354, 432

See application file for complete search history.

(56) References Cited

U.S. PATENT DOCUMENTS

| | | | | |
|---|---|---|---|---|
| 7,628,711 | B2 * | 12/2009 | Akinori et al. | 473/335 |
| 7,686,707 | B2 * | 3/2010 | Matsunaga et al. | 473/332 |
| 7,744,484 | B1 * | 6/2010 | Chao | 473/324 |
| 8,182,363 | B2 * | 5/2012 | Bezilla et al. | 473/335 |
| 8,192,302 | B2 * | 6/2012 | Knutson et al. | 473/335 |
| 2003/0162608 | A1 * | 8/2003 | Chen | 473/345 |
| 2006/0240907 | A1 * | 10/2006 | Latiri | 473/334 |
| 2006/0276263 | A1 * | 12/2006 | Lin et al. | 473/338 |
| 2007/0049400 | A1 | 3/2007 | Imamoto et al. | |

(Continued)

FOREIGN PATENT DOCUMENTS

TW M339333 U 9/2008

*Primary Examiner* — Sebastiano Passaniti

(74) *Attorney, Agent, or Firm* — Birch, Stewart, Kolasch & Birch, LLP

(57) ABSTRACT

A recess 14 is formed in a sole 9 of a head 4. The recess 14 is an example of an opening part. A socket 10 is mounted to the recess 14. A weight body 12 capable of being attached/detached is attached to the socket 10. The weight body 12 has an engaging part 32 and an exposed part E1. The socket 10 has an interposition part 11. The interposition part 11 is interposed in at least a part between the exposed part E1 and a head body h1 in an attached state where the engaging part 32 is placed at an engaging position EP. The exposed part E1 is exposed to the outside in the attached state. The interposition part 11 does not fix the weight body 12.

13 Claims, 12 Drawing Sheets

(56) References Cited

U.S. PATENT DOCUMENTS

| | | | | |
|---|---|---|---|---|
| 2007/0093316 | A1 | 4/2007 | Yamamoto | |
| 2007/0129161 | A1* | 6/2007 | Matsunaga et al. | 473/332 |
| 2008/0015049 | A1* | 1/2008 | Imamoto | 473/338 |
| 2008/0039229 | A1* | 2/2008 | Lo | 473/335 |
| 2008/0293516 | A1 | 11/2008 | Yamamoto | |
| 2009/0131200 | A1 | 5/2009 | Akinori et al. | |
| 2014/0024475 | A1* | 1/2014 | Motokawa | 473/338 |
| 2014/0038743 | A1* | 2/2014 | Nivanh | 473/324 |
| 2014/0187347 | A1* | 7/2014 | Yamamoto | 473/335 |
| 2014/0349779 | A1* | 11/2014 | Mizutani | 473/335 |
| 2014/0357402 | A1* | 12/2014 | Mizutani | 473/335 |

* cited by examiner

GOLF CLUB HEAD

The present application claims priority on Patent Application No. 2012-158619 filed in JAPAN on Jul. 17, 2012, the entire contents of which are hereby incorporated by reference.

BACKGROUND OF THE INVENTION

1. Field of the Invention

The present invention relates to a golf club head having a weight body.

2. Description of the Related Art

A head capable of changing the mass and position of a weight body has been known. The position of the center of gravity of the head can be adjusted by the weight body attached to the head. The adjustment of the position of the center of gravity facilitates fitting.

As a mechanism for attaching the weight body, a screw mechanism is typical. Meanwhile, Japanese Utility Model Application Publication No. 3142270 (US2009/0131200) discloses a mechanism including a sleeve and a weight. The gazette discloses a weight capable of being attached/detached by rotation. Japanese Patent Application Laid-Open No. 2007-117159 (US2007/0093316, US2008/0293516) discloses a head including a head body having an outer surface having a recess formed therein, a weight member disposed in the recess, and a first addition member disposed on the outside of the weight member. The first addition member contains a resin or a rubber as a base material. Japanese Patent Application Laid-Open No. 2007-83012 (US2007/0049400) discloses a head including a sole, a recess formed in the sole, an elastic body embedded in the recess, and a weight fixed to the elastic body so as to cover the elastic body.

SUMMARY OF THE INVENTION

It was found that sounding (abnormal noise) occurs in hitting in the head of Japanese Utility Model Application Publication No. 3142270. It was found that the weight hits the head body, which causes the sounding. A clearance is considered to be provided between the weight and the head body in order to prevent the sounding. However, sand, soil, grass and the like may enter the clearance. In the heads of Japanese Patent Application Laid-Open Nos. 2007-117159 and 2007-83012, the weight body cannot be easily attached/detached. In Japanese Patent Application Laid-Open No. 2007-83012, the weight and the head body are brought into contact with each other, which may cause the sounding.

It is an object of the present invention to provide a golf club head to/from which a weight body can be attached/detached, and which can suppress defects possibly occurring during the use of the golf club.

A golf club head according to the present invention includes: a head body having a crown and a sole; an opening part formed in the sole and opened to the outside; a socket mounted to the opening part; and a weight body capable of being attached/detached to/from the socket. The weight body can be attached/detached by relative rotation of an angle θ to the socket. The weight body has an engaging part and an exposed part. The socket has a first hole part, a second hole part, and an interposition part. The engaging part can take an engaging position EP and a non-engaging position NP in the second hole part by the relative rotation of the angle θ. The interposition part is interposed in at least apart between the exposed part and the head body in an attached state where the engaging part is placed at the engaging position EP. The exposed part is exposed to the outside in the attached state. The interposition part does not fix the weight body.

Preferably, a length B1 in an insertion direction of the interposition part is 0.5 mm or greater and 5 mm or less. Preferably, a full length S1 in an insertion direction of the socket is 5 mm or greater and 13 mm or less. Preferably, the interposition part does not protrude to the outside with respect to the weight body in the attached state. Preferably, the weight body does not protrude to the outside of the opening part in the attached state.

Preferably, a thickness B2 of the interposition part is 0.4 mm or greater and 1 mm or less. Preferably, an outer diameter B3 of the interposition part is 13 mm or greater and 17 mm or less.

Preferably, a material of the socket is an urethane-based polymer. Preferably, a hardness Hs of the socket is D40 or greater and D80 or less.

Preferably, a weight W1 of the weight body is 1 g or greater and 15 g or less.

Preferably, a shortest distance T1 between an inner surface of the crown and a bottom face of the socket in the attached state is 5 mm or greater and 15 mm or less.

Preferably, a head maximum thickness is 35 mm or greater and 70 mm or less.

DESCRIPTION OF THE PREFERRED EMBODIMENTS

Hereinafter, the present invention will be described in detail based on preferred embodiments with appropriate reference to the drawings.

A golf club head of the embodiment has a weight body attaching/detaching mechanism. The mechanism satisfies the Golf Rules defined by R&A (Royal and Ancient Golf Club of Saint Andrews). That is, the weight body attaching/detaching mechanism satisfies requirements specified in "1b Adjustability" in "1 Clubs" of "Appendix II Design of Clubs" defined by R&A. The requirements defined by the "1b Adjustability" are the following items (i), (ii), and (iii):

(i) the adjustment cannot be readily made;

(ii) all adjustable parts are firmly fixed and there is no reasonable likelihood of them working loose during a round; and (iii) all configurations of adjustment conform with the Rules.

Figure 1:
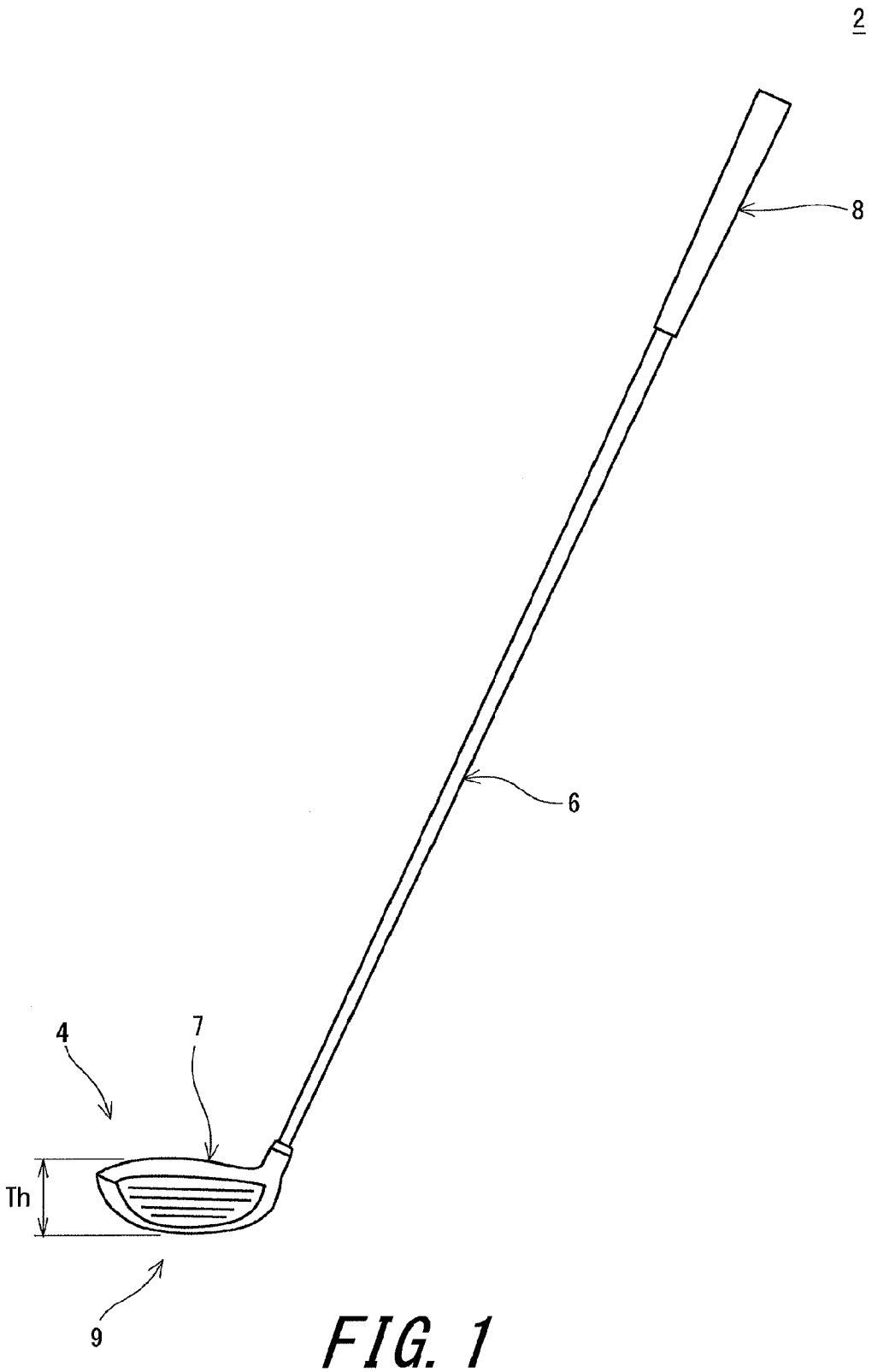
FIG. 1 is an overall view of a golf club having a head according to a first embodiment of the present invention.

FIG. 1 shows a golf club 2 provided with a head 4 of a first embodiment. The golf club 2 is provided with the head 4, a shaft 6, and a grip 8. The head 4 is mounted to one end part of the shaft 6. The grip 8 is mounted to the other end part of the shaft 6. The head 4 has a crown 7 and a sole 9. The head 4 is hollow.

The head 4 is a wood type head. The head 4 is exemplary. A utility type head, a hybrid type head, an iron type head, and a putter type head may be used in place of the head 4. The shaft 6 is a tubular body. Examples of the shaft 6 include a steel shaft and a so-called carbon shaft.

The head 4 is a so-called fairway wood. The real loft angle of the fairway wood is usually 12.5 degrees or greater and 29.0 degrees or less. The head volume of the fairway wood is usually 120 cc or greater and 220 cc or less. In the present invention, the club number and type of the head are not limited. However, a head having a comparatively small head maximum thickness Th is preferable. The details of the reason will be described later.

Examples of the other head having a comparatively small head maximum thickness Th include a utility type head or a hybrid type head. In the heads of these types, a real loft angle is usually 14.0 degrees or greater and 32.0 degrees or less, and a head volume is usually 100 cc or greater and 130 cc or less.

Figure 2:
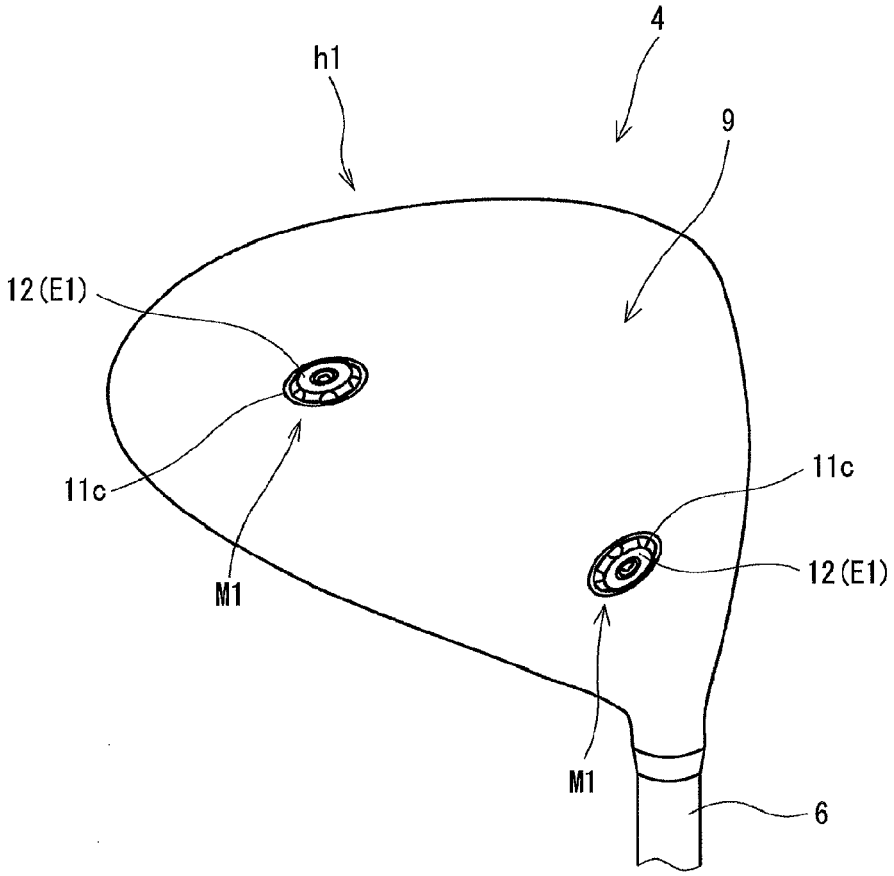
FIG. 2 is a perspective view of the head of FIG. 1.
Figure 3:
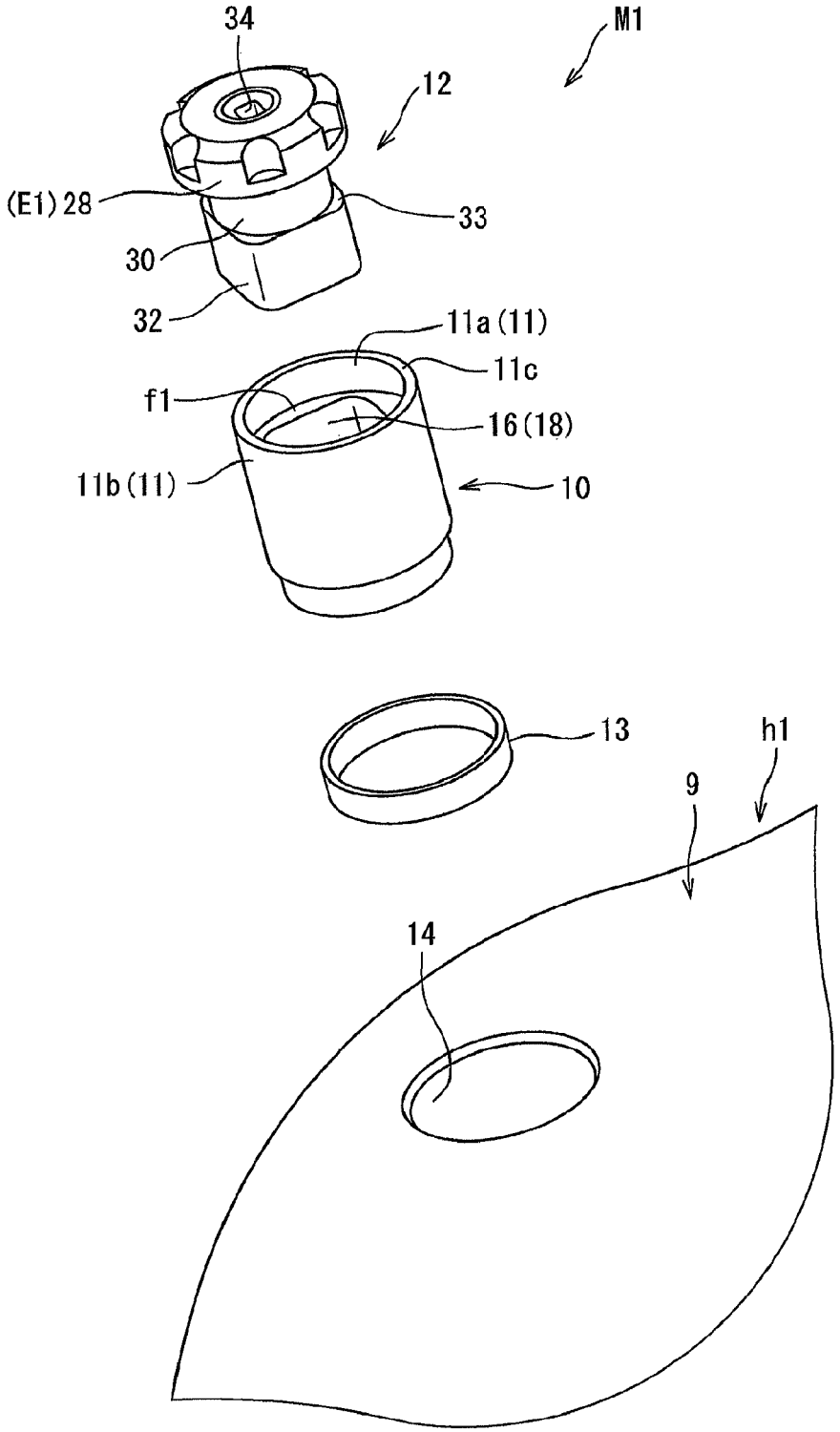
FIG. 3 is an exploded perspective view of a weight body attaching/detaching mechanism.

FIG. 2 is a perspective view of the golf club 2 viewed from the sole 9 side of the head 4. The head 4 has a head body h1 and a weight body attaching/detaching mechanism M1. FIG. 3 is an exploded perspective view of the weight body attaching/detaching mechanism M1. The weight body attaching/detaching mechanism M1 is provided with a socket 10 and a weight body 12. Furthermore, the weight body attaching/detaching mechanism M1 has a bottom face forming part 13. The head body h1 is provided with a recess 14. The recess 14 is an example of an opening part. The recess 14 is opened to the outside. The shape of the recess 14 corresponds to that (outer shape) of the socket 10. The inner diameter of the recess 14 is substantially equal to the outer diameter of the socket 10. The number of the recesses 14 is the same as that of the weight body attaching/detaching mechanisms M1. In the embodiment, two recesses 14 are provided. The number of the recesses 14 may be 1, 2, or equal to or greater than 3.

The bottom face forming part 13 may not exist. A through hole may be formed in the bottom part of the recess 14. The through hole may be formed in place of the recess 14.

As shown in FIG. 3, the socket 10 has an interposition part 11 and a hole 16. The interposition part 11 constitutes the upper part of the socket 10. The interposition part 11 constitutes a portion placed on the most sole surface side in the socket 10. The interposition part 11 extends toward an upper side (sole surface side) from an opening surface f1 of the hole 16. The interposition part 11 is cylindrical. The inner surface 11*a* of the interposition part 11 is a circumferential surface. The outer surface 11*b* of the interposition part 11 is a circumferential surface.

The socket 10 is fixed in the recess 14. The fixation is attained by an adhesive, for example. The weight body 12 is detachably mounted to the socket 10. Therefore, the weight body 12 can be attached/detached to/from the head 4.

In the embodiment, a plurality weight body attaching/detaching mechanisms M1 are provided. In the head 4, two weight body attaching/detaching mechanisms M1 are provided. The number of the weight body attaching/detaching mechanisms M1 is not limited. The position of the weight body attaching/detaching mechanism M1 is not limited.

Figure 4:
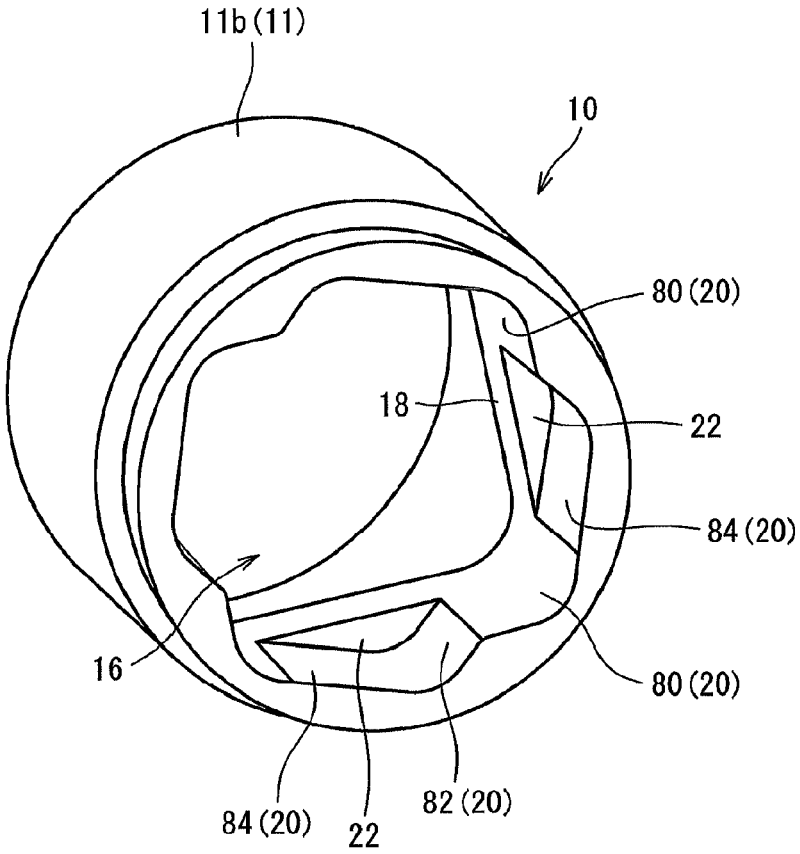
FIG. 4 is a perspective view of a socket shown in FIG. 3.
Figure 5:
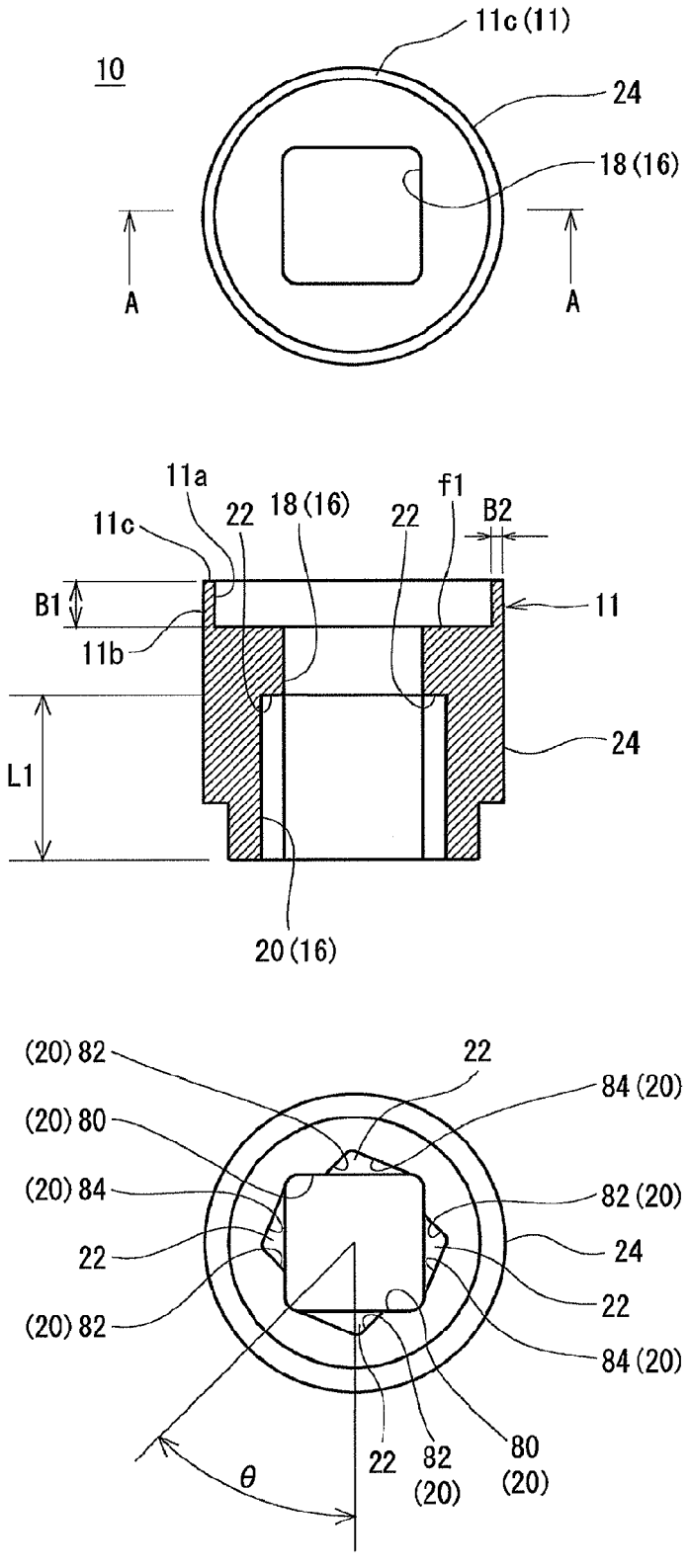
FIG. 5 is a plan view, a cross-sectional view, and a bottom view of the socket shown in FIG. 3.
Figure 6:
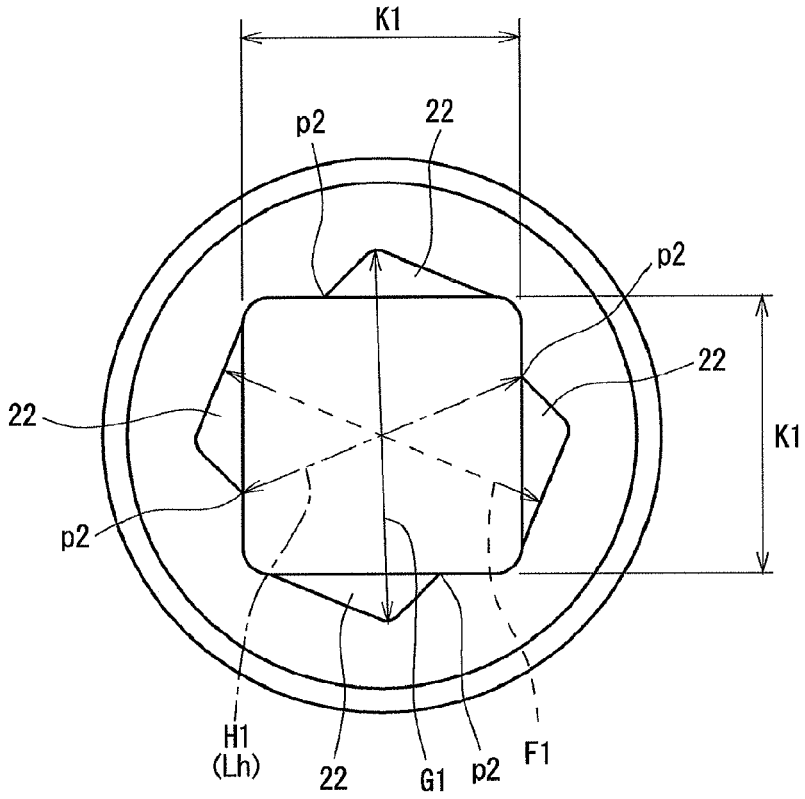
FIG. 6 is an enlarged view of the bottom view shown in FIG. 5.

FIG. 4 is a perspective view of the socket 10. FIG. 4 is a perspective view of the socket 10 viewed from a bottom face side. FIG. 5 shows a plan view of the socket 10, a cross-sectional view of the socket 10, and a bottom view of the socket 10 in this order from the top. The cross-sectional view of FIG. 5 is a cross-sectional view taken along line A-A of the plan view of FIG. 5. FIG. 6 is an enlarged view of the bottom view of FIG. 5.

The hole 16 has a first hole part 18, a second hole part 20, and a bump surface 22. A side surface 24 of the socket 10 is a cylindrical surface. The hole 16 extends through the socket 10. The hole 16 may not extend through the socket 10. The whole inner surface of the first hole part 18 smoothly continues. The whole inner surface of the second hole part 20 smoothly continues.

The sectional shape (the shape of the first hole part 18 in the plan view described on the uppermost side of FIG. 5) of the first hole part 18 is substantially equal to that of an engaging part 32 of the weight body 12. In the embodiment, the sectional shape of the first hole part 18 and the sectional shape of the engaging part 32 are substantially squares. These substantial squares are obtained by applying roundness to four corners of the square. It is preferable that a length L1 in an insertion direction of the second hole part 20 is substantially equal to a length L11 in an insertion direction of the engaging part 32 of the weight body 12, or is shorter than the length L11.

In the application, the insertion direction is an insertion direction of the weight body 12. In the embodiment, the insertion direction coincides with the axial direction of the weight body 12. In the embodiment, the insertion direction coincides with the axial direction of the socket 10.

Preferably, the material of the socket 10 is a polymer. The polymer is comparatively hard. When the weight body 12 is attached/detached, the polymer can be elastically deformed. The attaching/detaching scheme will be described later. The structure of the second hole part 20 of the hole 16 will be also described later.

Figure 7:
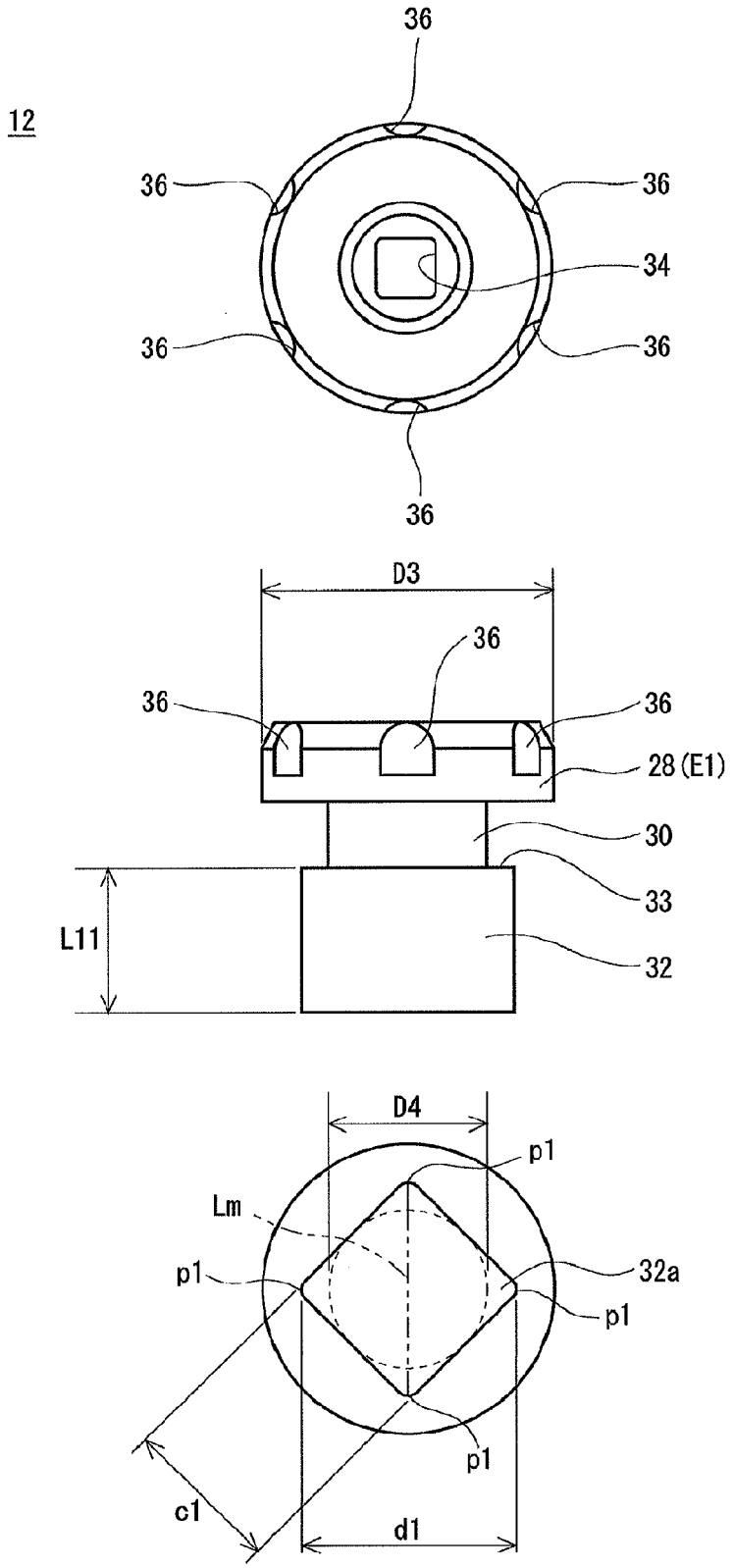
FIG. 7 is a plan view, a side view, and a bottom view of a weight body shown in FIG. 3.

FIG. 7 shows a plan view, a side view, and a bottom view of the weight body 12 in this order from the top. As shown in FIG. 7, the weight body 12 has a head part 28, a neck part 30, and the engaging part 32. The neck part 30 has a cylindrical shape. A noncircular hole 34 is formed at a center of an upper end face of the head part 28. In the embodiment, the noncircular hole 34 has a quadrangle shape. A plurality of cutouts 36 are formed in an outer peripheral surface of the head part 28. The head part 28 has an outer diameter D3 greater than an outer diameter D4 of the neck part.

The weight body 12 has an exposed part E1. In the embodiment, the head part 28 is the exposed part E1. The exposed part E1 does not independently contribute to the retention of the weight body 12. In other words, the exposed part E1 does not independently attain the retention. The opening surface f1 and the bump surface 22 which are shown in FIG. 5 are sandwiched between the exposed part E1 and the engaging part 32 at an engaging position EP, and thereby the movement in the insertion direction of the weight body 12 is regulated.

The exposed part E1 is located on the outermost side (sole surface side) of the weight body 12. In the attached state, the exposed part E1 is exposed to the outside.

The engaging part 32 has a noncircular section. In the embodiment, the section is a substantially square. The engaging part 32 can pass through the first hole part 18 of the hole 16. The engaging part 32 is a quadranglar prism. A size c1 is made the same as the outer diameter D4 of the neck part 30.

A size d1 is made greater than the outer diameter D4 of the neck part 30. A recess may be formed in a lower end face of the engaging part 32. A mass of the weight body 12 can be adjusted by a volume of a space (a space r1 which will be described later) formed by the recess. The size c1 and the size d1 will be described later.

The engaging part 32 has a corner part 32*a* as a protruding part. The corner part 32*a* protrudes to a direction (hereinafter, also referred to as an axial perpendicular direction) perpendicular to the insertion direction.

The engaging part 32 has an engaging surface 33. The engaging surface 33 is formed by a difference between the sectional shapes of the engaging part 32 and the neck part 30.

Preferably, the weight body 12 has a specific gravity greater than that of the socket 10. In respect of durability and a specific gravity, the material of the weight body 12 is preferably a metal. Examples of the metal include aluminum, an aluminium alloy, titanium, a titanium alloy, stainless steel, a tungsten alloy, and a tungsten nickel alloy (W—Ni alloy). An example of the titanium alloy is 6-4Ti (Ti-6Al-4V). An example of the stainless steel is SUS304.

Examples of a method for manufacturing the weight body include forging, casting, sintering, and NC process. In the case of the aluminium alloy, the 6-4Ti, and the SUS304, NC process is preferably performed after the casting. In the case of the W—Ni alloy, the NC process is preferably performed after the sintering or the casting. NC stands for "Numerical Control".

Figure 8:
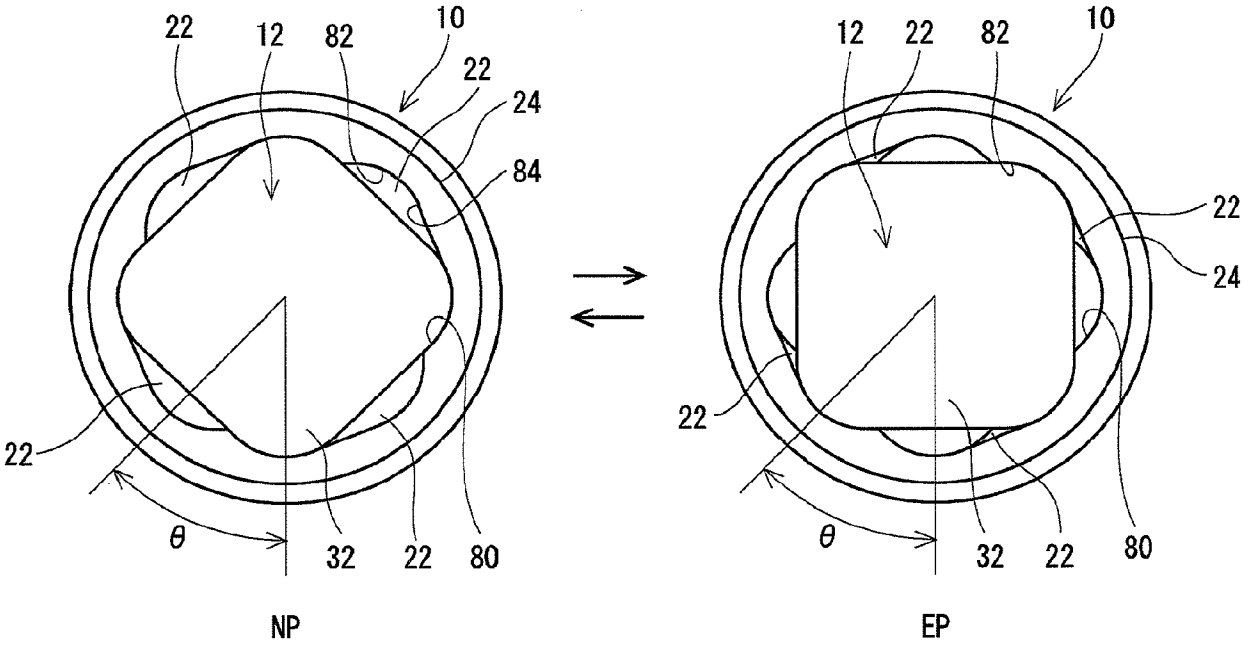
FIG. 8 shows a mutual transition of a non-engaging position NP and an engaging position EP, and is a bottom view thereof.

FIG. 8 shows a non-engaging position NP and engaging position EP of the weight body attaching/detaching mechanism M1. FIG. 8 is a bottom view of a state where the weight body 12 is inserted into the socket 10. The bottom face forming part 13 is not attached in FIG. 8.

As a relative relationship between the socket 10 and the weight body 12, the non-engaging position NP and the engaging position EP can be taken. At the non-engaging position NP, the weight body 12 can be extracted from the socket 10. Meanwhile, at the engaging position EP, the weight body 12 cannot be extracted from the socket 10. At the time of inserting the weight body 12 into the socket 10, the relative relationship between the socket 10 and the weight body 12 is the non-engaging position NP. The transition to the engaging position EP from the non-engaging position NP is made by rotation of a relative angle θ. The return to the non-engaging position NP from the engaging position EP is made by inverse rotation of the relative angle θ. In the weight body attaching/detaching mechanism M1, the weight body 12 can be attached/detached by merely applying the rotation of the angle θ. The weight body attaching/detaching mechanism M1 has excellent easiness of attachment/detachment.

In the present application, a state where the weight body 12 is placed at the engaging position EP is also referred to as an attached state. In the attached state, the exposed part E1 (head part 28) is exposed to the outside (see FIG. 2). An end face 11*c* (see FIGS. 2 and 3) of the interposition part 11 is exposed to the outside. However, the end face 11*c* of the interposition part 11 does not protrude to the outside of the recess 14.

In the embodiment, the angle θ is 45 degrees. The angle θ is not limited to 45 degrees. Examples of the angle θ include 30 degrees and 60 degrees.

Figure 9:
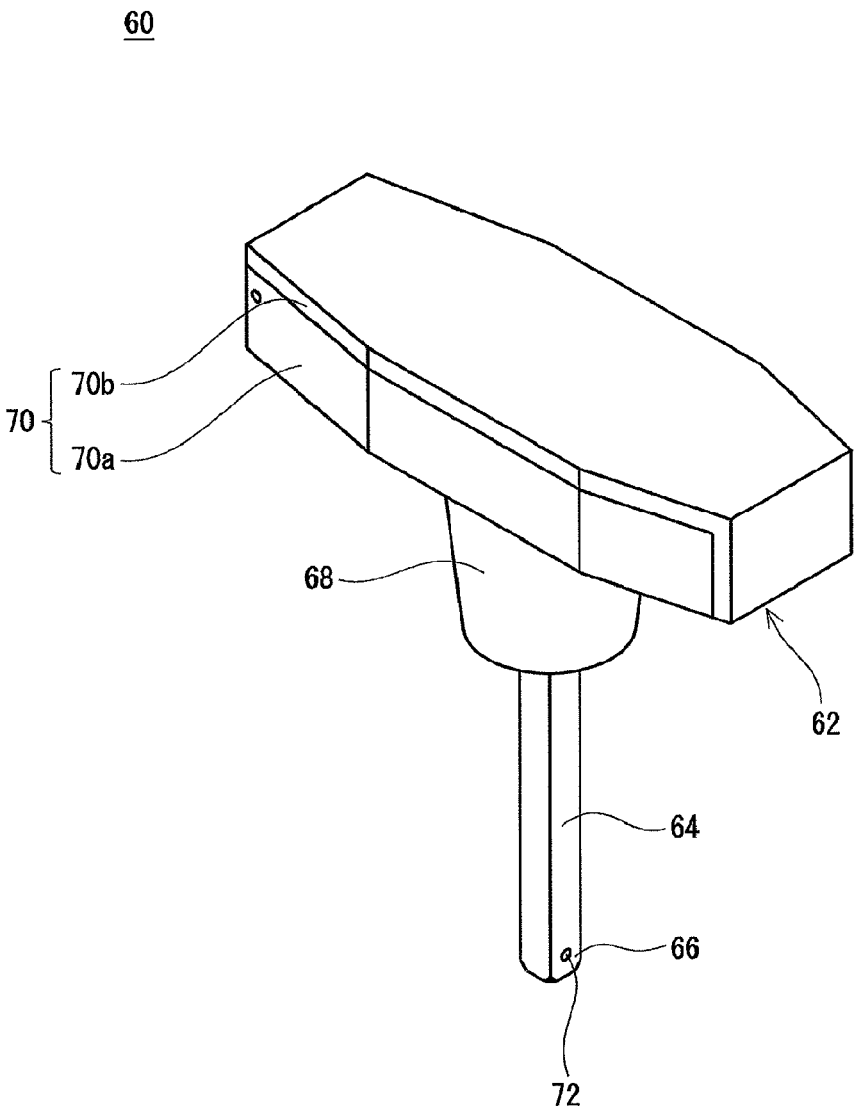
FIG. 9 is a perspective view showing an example of a tool used for attaching/detaching the weight body.

An exclusive tool can be used in the weight body attaching/detaching mechanism M1. FIG. 9 is a perspective view showing a tool 60 as an example of the exclusive tool. The tool 60 is used for attaching/detaching the weight body 12. The tool 60 has a handle 62, a shaft 64, and a tip part 66. The handle 62 has a handle body 68 and a holding part 70. The holding part 70 extends in a direction vertically crossing with a rotation axis of the tool 60 from the handle body 68. The holding part 70 has a holding part body 70*a* and a lid 70*b*.

A back end part of the shaft 64 is fixed to the holding part body 70*a*. A section of the tip part 66 of the shaft 64 corresponds to a shape of the noncircular hole 34 of the weight body 12. In the embodiment, the tip part 66 has a quadrangle section. A pin 72 protrudes from a side surface of the tip part 66. The pin 72 is provided in the tip part 66. Although not shown in the drawings, an elastic body (coil spring) is built in the tip part 66. The pin 72 is biased in a protruding direction by a biasing force of the elastic body.

When the weight body 12 is attached/detached, the lid 70*b* is closed. A weight body housing part (not shown) is provided in the holding part body 70*a*. Preferably, the weight body housing part can house the plurality of weight bodies 12. The weight bodies 12 can be taken out by opening the lid 70*b*.

Figure 10:
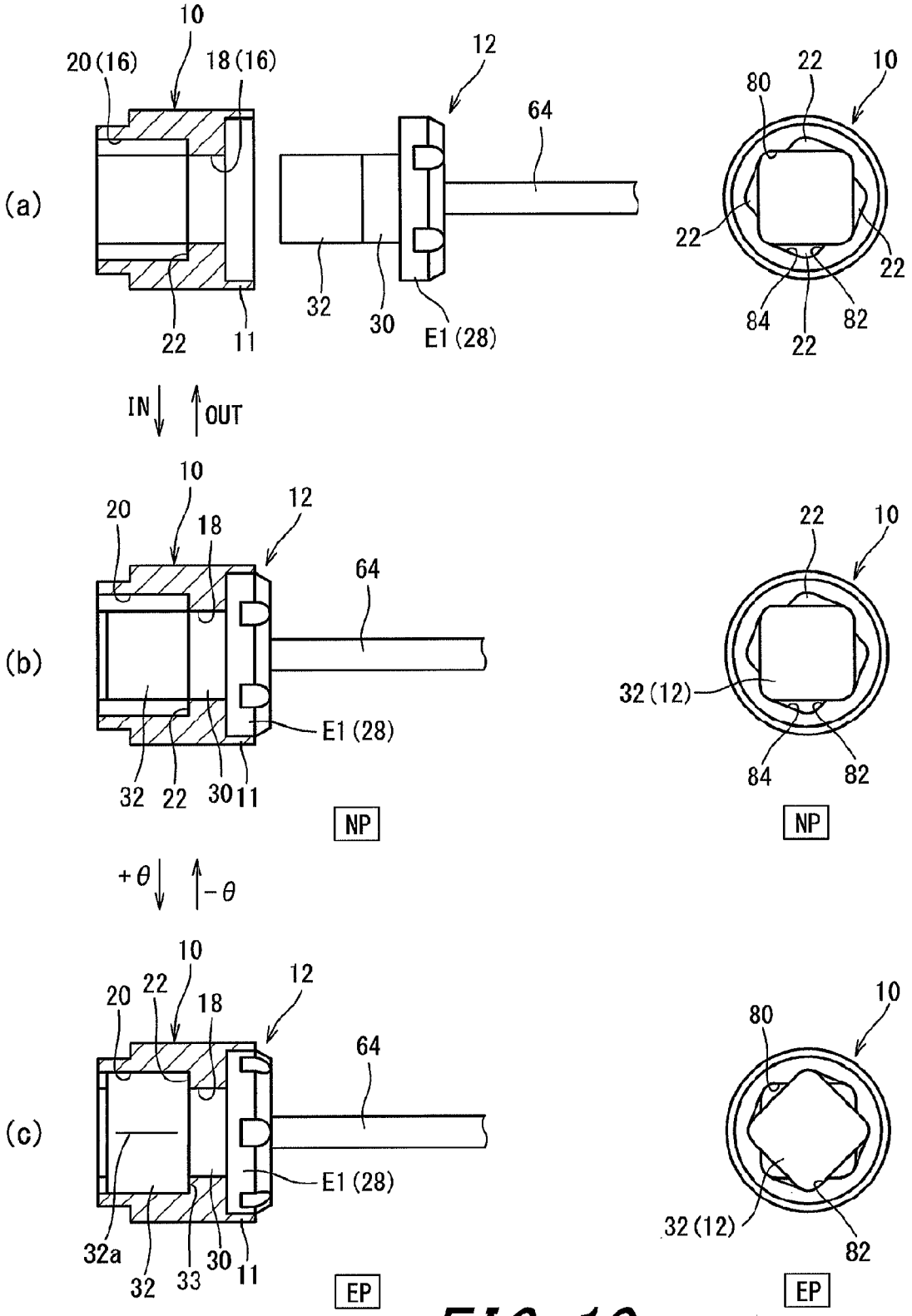
FIG. 10 describes a method for attaching/detaching the weight body.

FIG. 10 is a view for describing an example of a method for attaching/detaching the weight body 12. Symbol (a) of FIG. 10 shows a state before the weight body 12 is attached. Symbol (b) of FIG. 10 shows a state immediately after the weight body 12 is inserted. Symbol (c) of FIG. 10 shows a state where the weight body 12 is rotated and is fixed to the socket 10. In each of symbols (a), (b), and (c) of FIG. 10, the socket 10 viewed from the bottom face side is shown on a right end.

The tip part 66 of the tool 60 is inserted into the noncircular hole 34 of the weight body 12 when the weight body 12 is attached. The pin 72 presses the noncircular hole 34 while going backward according to the insertion. The weight body 12 is less apt to fall off from the tip part 66 by the pressing force. As shown in symbol (a) and (b) of FIG. 10, the weight body 12 held by the shaft 64 of the tool 60 is inserted into the hole 16.

As shown in symbol (b) of FIG. 10, the engaging part 32 of the weight body 12 passes through the first hole part 18 of the hole 16, and leads to the second hole part 20. Symbol (b) of FIG. 10 shows the non-engaging position NP. The weight body 12 can be extracted from the hole 16 at the non-engaging position NP.

Next, relative rotation of an angle θ(+θ) is performed. Specifically, the weight body 12 is rotated by the angle θ (+θ) with respect to the socket 10 using the tool 60. The transition to the engaging position EP from the non-engaging position NP is attained by the rotation. Symbol (c) of FIG. 10 shows the engaging position EP. The weight body 12 is fixed to the socket 10 at the engaging position EP. At the engaging position EP, the weight body 12 is not separated by hitting.

When the weight body 12 is removed, reverse rotation of an angle θ is performed. In other words, rotation of an angle −θ is performed. The transition to the non-engaging position NP from the engaging position EP is attained by the rotation. The weight body 12 can be easily removed at the non-engaging position NP.

At the engaging position EP, the weight body 12 cannot be extracted from the hole 16. This is because the extraction of the weight body 12 is inhibited by engaging the bump surface 22 of the hole 16 with the engaging surface 33 of the weight body 12 at the engaging position EP. The tool 60 can be easily extracted from the noncircular hole 34 of the weight body 12 at the engaging position EP.

As shown in FIGS. 5 and 8 or the like, the second hole part 20 of the hole 16 has a surface (non-engaging corresponding surface) 80 corresponding to the engaging part 32 located at the non-engaging position NP, a surface (engaging corresponding surface) 82 corresponding to the engaging part 32 located at the engaging position EP, and a resistance surface 84. The resistance surface 84 is pressed by (the corner part 32*a* of) the engaging part 32 in the middle of the relative rotation between the non-engaging position NP and the engaging position EP. A frictional force is generated between the engaging part 32 and the second hole part 20 by the pressing. The resistance surface 84 is elastically deformed by the pressing. The material of the second hole part 20 is a comparatively hard polymer, and thereby the frictional force is increased. The increased frictional force generates a strong rotation resistance. A strong torque is required for the mutual transition of the non-engaging position NP and the engaging position EP by the rotation resistance. Therefore, the tool 60 is required for the mutual transition. The mutual transition cannot be attained with empty hands without using the tool 60. The weight body 12 located at the engaging position EP is not separated by strong impact shock in hitting.

Thus, the weight body can be attached/detached by merely performing the relative rotation of the angle θ in the weight body attaching/detaching mechanism M1.

The number N1 of the attaching/detaching mechanisms M1 is not limited. In respect of a degree of freedom for adjusting the position of the center of gravity of the head, the number N1 is preferably equal to or greater than 2.

[Interposition Part]

In the attached state, the interposition part 11 is interposed in at least a part between the exposed part E1 and the head body h1. In the embodiment, the interposition part 11 is cylindrical. In the embodiment, the interposition part 11 exists over the whole periphery of the exposed part E1. Therefore, the effect caused by the interposition part 11 is enhanced. The interposition part 11 may be disposed in only a part of the periphery of the exposed part E1.

In the attached state, the interposition part 11 is not engaged with the weight body 12. In the attached state, the interposition part 11 is not engaged with the exposed part E1. Even when the interposition part 11 is brought into contact with the weight body 12, the interposition part 11 has no effect of stopping the weight body 12 in an engaged state. The interposition part 11 does not fix the weight body 12.

The impact shock caused by hitting can vibrate the weight body 12. The amplitude of the vibration is apt to be increased in the exposed part E1 (head part 28). This is because the exposed part E1 is in a state where it is apt to be comparatively moved without being engaged with the interposition part 11. The interposition part 11 can effectively absorb the vibration of the exposed part E1. Impact shock absorbing performance can be improved by suppressing the vibration of a portion (exposed part E1) which is likely to be vibrated. The impact shock absorbing performance can contribute to improvement in hit ball feeling. The hit ball feeling can be improved by the interposition part 11. Since the interposition part 11 does not fix the weight body 12, the interposition part 11 is likely to be deformed. Therefore, the vibration absorbing performance can be effectively improved by the interposition part 11.

Figure 11:
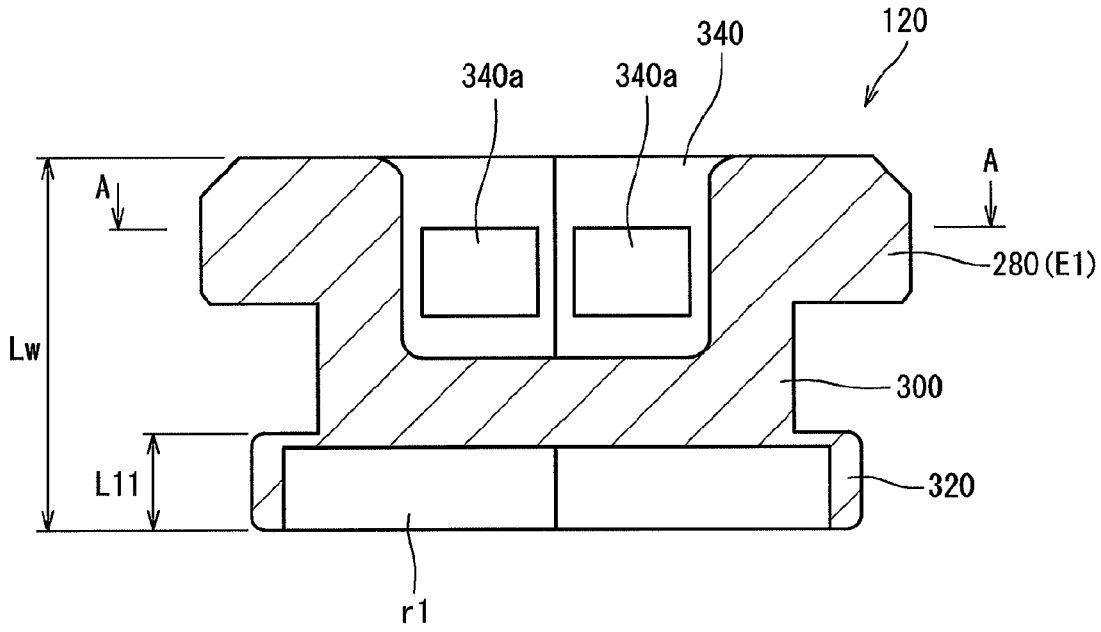
FIG. 11 is a cross-sectional view of a weight body of a modification.
Figure 12:
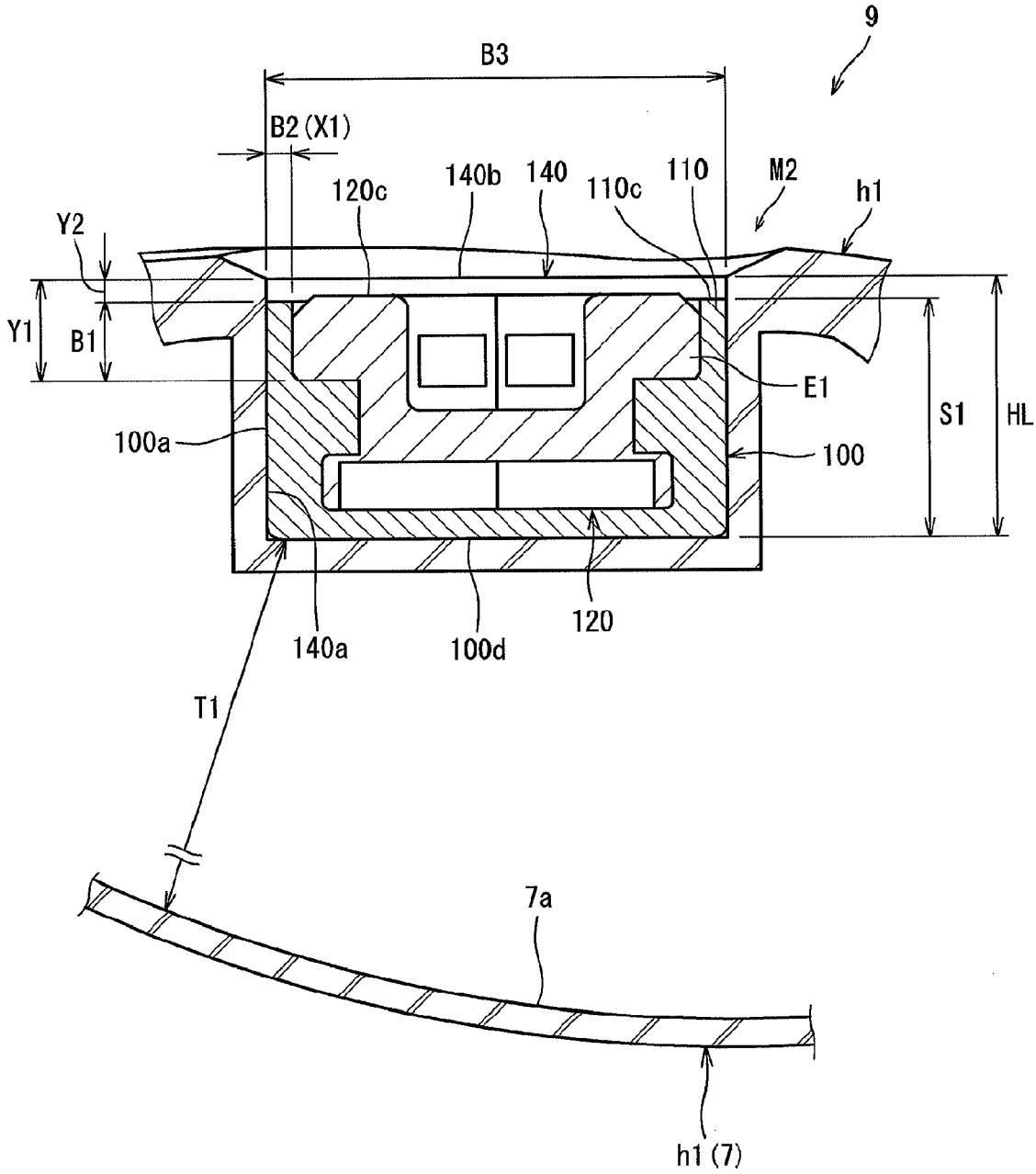
FIG. 12 is a cross-sectional view of a weight body attaching/detaching mechanism of the modification.

FIG. 11 is a cross-sectional view of a weight body 120 of a modification. FIG. 12 is a cross-sectional view of a weight body attaching/detaching mechanism M2 when the weight body 120 is in an attached state. The principle of the weight body attaching/detaching mechanism M2 is the same as that of the weight body attaching/detaching mechanism M1.

The weight body attaching/detaching mechanism M2 is provided with a socket 100 and the weight body 120. The head body h1 is provided with a recess 140. The shape of the recess 140 corresponds to that (outer shape) of the socket 100. The inner diameter of the recess 140 is substantially equal to the outer diameter of the socket 100. The outer surface of the socket 100 is bonded to the inner surface of the recess 140. An outer peripheral surface 100*a* of the socket 100 is bonded to an inner peripheral surface 140*a* of the recess 140.

As shown in FIG. 12, the socket 100 has an interposition part 110. The interposition part 110 constitutes the upper part of the socket 100. The interposition part 110 constitutes a portion placed on the most sole surface side in the socket 100. The interposition part 110 is cylindrical.

As shown in FIG. 11, the weight body 120 has a head part 280, a neck part 300, and an engaging part 320. The neck part 300 has a cylindrical shape. A noncircular hole 340 is formed at a center of an upper end face of the head part 280. As in the noncircular hole 34, the sectional shape (the shape of the section taken along line A-A of FIG. 11) of the noncircular hole 340 is a substantially quadrangle.

The weight body 120 has an exposed part E1. In the embodiment, the head part 280 is the exposed part E1.

The exposed part E1 is located on the outermost side (sole surface side) of the weight body 120. In the attached state, the exposed part E1 is exposed to the outside (see FIG. 12).

A clearance distance X1 between the exposed part E1 (head part 280) and the head body h1 is equal to a thickness B2 of the interposition part, or greater than the thickness B2. That is, X1≥B2 is set. The thickness B2 of the interposition part is measured in a natural state where the socket 100 is independently left. If a difference (X1−B2) is small, a foreign matter is less apt to enter. In this respect, the difference (X1−B2) is preferably equal to or less than 0.3 mm, and more preferably equal to or less than 0.2 mm. Meanwhile, if the difference (X1−B2) is excessively small, workability for the attaching/detaching the weight body may be decreased. In this respect, the difference (X1−B2) is preferably equal to or greater than 0.05 mm, and more preferably equal to or greater than 0.075 mm.

There are differences between the weight body 12 and the weight body 120. A first difference is the length L11 of the engaging part 320. The length L11 of the engaging part 320 is shorter than that of the engaging part 32. The engaging part 320 is flatter than the engaging part 32. As a result, a full length Lw of the weight body 120 is shorter than that of the weight body 12. The full length Lw of the weight body 120 is a length along the insertion direction. A second difference is that a recess 340*a* is formed in the inner surface of the noncircular hole 340. The recess 340*a* provides a space to which the pin 72 of the tool 60 protrudes. If the shaft 64 of the tool 60 is inserted into the noncircular hole 340, the pin 72 protrudes in the recess 340*a*. The pin 72 is engaged with the recess 340*a* by the protrusion. The shaft 64 is less apt to be pulled out of the noncircular hole 340 by the engagement. Therefore, the attaching/detaching work of the weight body 120 can be smoothly performed.

As shown in FIG. 11, the space r1 is provided in the engaging part 320. A weight W1 of the weight body can be changed without changing the outer shape of the weight body 120 by adjusting the volume of the space r1. Furthermore, the weight W1 of the weight body can be changed without changing the outer shape of the weight body 120 by changing the material of the weight body 120. Therefore, a plurality of weight bodies 120 having different weights W1 and the same outer shape can be prepared. Therefore, the weight bodies 120 having different weights W1 can be attached to the same socket 100.

In respect of appearance, it is preferable that an end face 110*c* of the interposition part 110 does not protrude to the outside with respect to an end face 120*c* of the weight body 120.

In FIG. 12, the weight body 120 is in an attached state. In the attached state, the interposition part 110 does not protrude to the outside with respect to the weight body 120 (an upper side in FIG. 12). The appearance can be improved by the non-protrusion. A grounding resistance on a sole surface can be suppressed by the non-protrusion.

In the attached state, a full length S1 is equal to or less than a depth HL (S1≤HL). The interposition part 110 does not protrude to the outside of the recess 140. As shown in FIG. 12, the end face 110*c* of the interposition part 110 is located on an inner side in an insertion direction (a lower side in FIG. 12) with respect to an opening edge 140*b* of the recess 140. The appearance can be improved by the non-protrusion. The grounding resistance on the sole surface can be suppressed by the non-protrusion.

In the attached state, the weight body 120 does not protrude to the outside of the recess 140. As shown in FIG. 12, the end face 120*c* of the weight body 120 is located on the inner side in the insertion direction (a lower side in FIG. 12) with respect to the opening edge 140*b* of the recess 140. The appearance may be improved by the non-protrusion. The grounding resistance on the sole surface is suppressed by the non-protrusion, and the weight body 120 is less apt to fall off. The adhesion of the foreign matter can be suppressed by the non-protrusion.

In the embodiment of FIG. 12, an adhesion area between the recess 140 and the socket 100 is secured while the depth HL and the full length S1 are suppressed. Therefore, the fixing strength of the socket 100 is high. Since the depth HL is suppressed, a degree of freedom in design of the head is improved. In the fairway wood, the utility type head, and the hybrid type head or the like, the head maximum thickness Th is small. Since the depth HL and the full length S1 are small in the embodiment, the embodiment can be preferably applied to also a head having a small head maximum thickness Th.

The grounded ball is often hit by the fairway wood, the utility type head, and the hybrid type head or the like unlike a driver. Therefore, foreign matters such as sand, soil, and grass are apt to adhere. In the embodiment of FIG. 12, a clearance between the exposed part E1 and the recess 140 is decreased by the existence of the interposition part 110. Therefore, the entering of the foreign matter to the clearance is suppressed.

A length in an insertion direction of the interposition part 110 is shown by symbol B1 in FIG. 12. When the length B1 is excessively small, a clearance between the exposed part E1 (head part 280) and the head body h1 is apt to be generated. Foreign matters such as mud, soil, sand of a bunker, and grass may enter the clearance. The foreign matter decreases the appearance. When the length B1 is excessively small, sounding may be caused. The sounding is caused by contact between the weight body 120 and the head body h1. Furthermore, when the length B1 is excessively small, the adhesion area between the socket 100 and the recess 140 is decreased. In these respects, the length B1 is preferably equal to or greater than 0.5 mm, more preferably equal to or greater than 1.0 mm, and still more preferably equal to or greater than 1.5 mm. When the length B1 is excessively large, the depth HL of the recess 140 is increased. The excessive depth HL decreases the degree of freedom in the design of the head. In a head having a small head height (a so-called shallow head), the depth HL has restrictions. When the length B1 is excessively large, the interposition part 110 is apt to be brought into contact with the ground. In these respects, the length B1 is preferably equal to or less than 5 mm, more preferably equal to or less than 4.5 mm, and still more preferably equal to or less than 4 mm.

A thickness of the interposition part 110 is shown by symbol B2 in FIG. 12. When the thickness B2 is excessively small, formability is decreased. If the thickness B2 is excessively small, the interposition part 110 is apt to be deformed when the weight body is inserted. The insertion of the weight body may not be smoothed by the deformation. In these respects, the thickness B2 is preferably equal to or greater than 0.4 mm, more preferably equal to or greater than 0.5 mm, and still more preferably equal to or greater than 0.6 mm. When the weight of the socket 100 is excessively large, a degree of freedom in design of the weight body and the head may be constrained. In this respect, the thickness B2 is preferably equal to or less than 1 mm, more preferably equal to or less than 0.9 mm, and still more preferably equal to or less than 0.8 mm.

An outer diameter of the socket 100 is shown by symbol B3 in FIG. 12. In the embodiment, the outer diameter of the socket 100 is substantially equal to that of the interposition part 110. If the outer diameter B3 of the interposition part is excessively small, it may become difficult to design and manufacture the weight body. If the outer diameter B3 of the interposition part is excessively small, the adhesion area between the socket 100 and the recess 140 is decreased. In these respects, the outer diameter B3 is preferably equal to or greater than 13 mm, more preferably equal to or greater than 13.5 mm, and still more preferably equal to or greater than 14 mm. When the inner diameter of the recess 140 is excessively large, a degree of freedom in design of the head is constrained. When the outer diameter B3 is excessively large, the formability of the socket 100 may be decreased. In these respects, the outer diameter B3 is preferably equal to or less than 17 mm, more preferably equal to or less than 16.5 mm, and still more preferably equal to or less than 16 mm.

A full length in an insertion direction of the socket 100 is shown by symbol S1 in FIG. 12. In respect of increasing an adhesion area between the socket 100 and the head body h1, the full length S1 is preferably equal to or greater than 5 mm, and more preferably equal to or greater than 6 mm. When the full length S1 is excessively large, the depth HL becomes excessively large. In this case, the position of a center of gravity of the head body h1 is apt to become high. When the full length S1 is excessively large, the weight of the socket 100 becomes excessively large, which may constrain the design in the position of the center of gravity of the head. In these respects, the full length S1 is preferably equal to or less than 13 mm, and more preferably equal to or less than 12 mm.

A part of the crown 7 is illustrated in the cross-sectional view of FIG. 12. The crown 7 is a part of the head body h1. In order to save the space of the drawing, a distance between the crown 7 and the sole 9 is nearer than in reality in FIG. 12.

A shortest distance between an inner surface 7*a* of the crown 7 and a bottom face 100*d* of the socket 100 is shown by symbol T1 in FIG. 12. In respect of lowering the center of gravity of the head, the shortest distance T1 is preferably equal to or greater than 5 mm. In respect of increasing the full length S1 and the full length Lw to secure the volume of the weight body, the shortest distance T1 is preferably equal to or less than 15 mm, and more preferably equal to or less than 12 mm.

A head maximum thickness is shown by a double-headed arrow Th in FIG. 1. The head maximum thickness Th is measured in a reference state. The reference state is a state where the head is placed at a predetermined lie angle and face angle on a level surface h. In the reference state, a maximum distance between the outer surface of the crown and the level surface h is the head maximum thickness Th. The thickness Th is measured along a direction perpendicular to the level surface h. In respect of making the head weight and the head volume proper, the head maximum thickness Th is preferably equal to or greater than 35 mm. In respect of making the head weight and the head volume proper, the head maximum thickness Th is preferably equal to or less than 70 mm, more preferably equal to or less than 55 mm, and still more preferably equal to or less than 45 mm.

As described above, in the embodiment, the adhesion of the foreign matter can be suppressed. Since the foreign matter is apt to adhere when the weight body attaching/detaching mechanism is placed at a position where it is likely to be grounded, an effect of suppressing the adhesion of the foreign matter is significantly exhibited. In this respect, a shortest distance Ds (not shown) between the weight body 120 which is in the attached state and the level surface h in the reference state is preferably equal to or less than 15 mm, more preferably equal to or less than 10 mm, and still more preferably equal to or less than 5 mm.

In respect of enhancing an effect of weight adjustment, the weight W1 of the weight body is preferably equal to or greater than 1 g, more preferably equal to or greater than 1.5 g, and still more preferably equal to or greater than 2 g. When the weight W1 is excessively large, a large centrifugal force acts on the weight body. The large centrifugal force increases a load to the socket. In this respect, the weight W1 of the weight body is preferably equal to or less than 15 g, more preferably equal to or less than 14 g, and still more preferably equal to or less than 13 g.

[Hardness Hs of Socket]

In respect of surely fixing the weight body 12 and of suppressing sounding in hitting, the hardness Hs of the socket 10 is preferably equal to or greater than D40, more preferably equal to or greater than D42, and still more preferably equal to or greater than D45. In respect of suppressing wear caused by the weight body 12, the hardness Hs is preferably equal to or less than D80, more preferably equal to or less than D78, and still more preferably equal to or less than D76.

The hardness Hs is measured in accordance with regulation of "ASTM-D 2240-68" by using a Shore D type hardness scale mounted to an automated rubber hardness measuring device ("PI" (trade name) manufactured by Koubunshi Keiki Co., Ltd.) The shape of a measurement sample is set to a cube having a side length of 3 mm. Measurement is performed under a temperature of 23° C. When possible, the measurement sample is cut out from the socket 10. When it is difficult to cut out the measurement sample, a measurement sample made of the same resin composition as that of the socket 10 is used.

When a ball is hit by the golf club 2, hitting vibration is transmitted to golf player's hands via the golf club 2. The vibrational energy of the hitting vibration is transformed into the kinetic energy of the weight body 120 housed in the socket 100. The socket 100 and the weight body 120 transform the vibrational energy of the shaft 6 into the kinetic energy of the weight body 120, and thereby the hitting vibration can be alleviated. Furthermore, because the vibration of the exposed part E1 of the weight body 120 is absorbed by the interposition part 110, the vibration absorbing performance is effectively improved.

[Polymer]

In respect of a hardness, the material of the socket is preferably a polymer. Examples of the polymer include a thermosetting polymer and a thermoplastic polymer. Examples of the thermosetting polymer include a phenol resin, an epoxy resin, a melamine resin, a urea resin, an unsaturated polyester resin, an alkyd resin, a thermosetting polyurethane, a thermosetting polyimide, and a thermosetting elastomer. Examples of the thermoplastic polymer include polyethylene, polypropylene, polyvinyl chloride, polystyrene, polytetrafluoroethylene, an ABS resin (acrylonitrile butadiene styrene resin), an acrylic resin, polyamide, polyacetal, polycarbonate, modified polyphenylene ether, polybutylene terephthalate, polyethylene terephthalate, polyphenylene sulfide, polyether ether ketone, a thermoplastic polyimide, polyamide imide, and a thermoplastic elastomer.

Examples of the thermoplastic elastomer include a thermoplastic polyamide elastomer, a thermoplastic polyester elastomer, a thermoplastic polystyrene elastomer, a thermoplastic polyester elastomer, and a thermoplastic polyurethane elastomer.

In respect of durability, an urethane-based polymer and polyamide are preferable, and the urethane-based polymer is more preferable. Examples of the urethane-based polymer include polyurethane and a thermoplastic polyurethane elastomer. The urethane-based polymer may be thermoplastic, and may be thermosetting. In respect of formability, a thermoplastic urethane-based polymer is preferable, and the thermoplastic polyurethane elastomer is more preferable.

In respect of formability, the thermoplastic polymer is preferable. In respect of a hardness and durability, in the thermoplastic polymer, the polyamide and the thermoplastic polyurethane elastomer are preferable, and the thermoplastic polyurethane elastomer is more preferable.

Examples of the polyamide include nylon 6, nylon 11, nylon 12, and nylon 66.

A preferable thermoplastic polyurethane elastomer contains a polyurethane component as a hard segment, and a polyester component or a polyether component as a soft segment. That is, preferable examples of the thermoplastic polyurethane elastomer (TPU) include a polyester-based TPU and a polyether-based TPU. Examples of a curing agent for the polyurethane component include cycloaliphatic diisocyanate, aromatic diisocyanate, and aliphatic diisocyanate.

Examples of the cycloaliphatic diisocyanate include 4,4'-dicyclohexylmethane diisocyanate ($H_{12}$MDI), 1,3-bis(isocyanatomethyl)cyclohexane ($H_6$XDI), isophorone diisocyanate (IPDI), and trans-1,4-cyclohexane diisocyanate (CHDI).

Examples of the aromatic diisocyanate include diphenylmethane diisocyanate (MDI) and toluene diisocyanate (TDI). Examples of the aliphatic diisocyanate include hexamethylene diisocyanate (HDI).

Commercially available examples of the thermoplastic polyurethane elastomer (TPU) include "Elastollan" (trade name) manufactured by BASF Japan Ltd.

Specific examples of the polyester-based TPU include "Elastollan C70A", "Elastollan C80A", "Elastollan C85A", "Elastollan C90A", "Elastollan C95A", and "Elastollan C64D".

Specific examples of the polyether-based TPU include "Elastollan 1164D", "Elastollan 1198A", "Elastollan 1180A", "Elastollan 1188A", "Elastollan 1190A", "Elastollan 1195A", "Elastollan 1174D", "Elastollan 1154D", and "Elastollan ET385".

A fiber reinforced resin containing each of the polymers as a matrix may be used.

[Size c1]

A distance between opposed surfaces of the engaging part 32 is shown by a double pointed arrow c1 in FIG. 7. The size c1 is equal to a length of a side of a square obtained by eliminating the roundness of a corner existing in the section of the engaging part 32.

[Size d1]

A longest sectional size of the engaging part 32 is shown by a double pointed arrow d1 in FIG. 7. In the embodiment, the size d1 is a length of a diagonal line of the section (substantially square) of the engaging part 32. The size d1 is a length of the longest cross line Lm (see FIG. 7) of the engaging part 32. Both end points of the longest cross line Lm are shown by symbol p1 in FIG. 7. These points p1 are peaks in the section of the engaging part 32.

[Size F1]

A distance between resistance surfaces 84 opposed to each other is shown by a dashed line double pointed arrow F1 in FIG. 6. The size F1 is measured at a position where elastic deformation is maximized in the relative rotation. The size F1 is correlated with the maximum value of a torque required in the relative rotation.

[Size K1]

An opening width of the first hole part 18 of the hole 16 is shown by a double pointed arrow K1 in FIG. 6. The size K1 is equal to a length of a side of a square obtained by eliminating the roundness of a corner existing in the section of the first hole part 18.

[Size G1]

A cross length of the second hole part 20 between positions with which both the end points p1 of the longest cross line Lm are brought into contact at the engaging position EP is shown by a double pointed arrow G1 in FIG. 6.

[Size H1]

A length of a shortest cross line Lh of the second hole part 20 is shown by a dashed line double pointed arrow H1 in FIG. 6. Both end points p2 of the shortest cross line Lh are boundary points between an engagement corresponding surface 82 and a non-engagement corresponding surface 80.

[F1/d1]

In respect of suppressing the scraping of the inner surface of the socket when the weight body 12 is attached/detached, a ratio (F1/d1) is preferably equal to or greater than 0.935, more preferably equal to or greater than 0.940, and still more preferably equal to or greater than 0.945. In respect of surely fixing the weight body 12 and of suppressing sounding in hitting, the ratio (F1/d1) is preferably equal to or less than 0.965, more preferably equal to or less than 0.960, and still more preferably equal to or less than 0.955.

In the middle of the relative rotation, the amount of deformation of the resistance surface 84 is maximized. As the maximum amount of the deformation is greater, the ratio (F1/d1) is less.

[G1/d1]

In respect of suppressing the scraping of the inner surface of the socket when the weight body 12 is attached/detached, a ratio (G1/d1) is preferably equal to or greater than 0.987, more preferably equal to or greater than 0.989, and still more preferably equal to or greater than 0.991. In respect of surely fixing the weight body 12 and of suppressing sounding in hitting, the ratio (G1/d1) is preferably equal to or less than 0.996, more preferably equal to or less than 0.995, and still more preferably equal to or less than 0.994.

[K1−c1]

When a difference (K1−c1) is excessively small, the catching of the weight body 12 is apt to be caused when the weight body 12 is extracted. Therefore, the smoothness of attachment/detachment may be inhibited. In respect of easily extracting the weight body 12 at the non-engaging position NP, the difference (K1−c1) is preferably equal to or greater than 0.3 mm, more preferably equal to or greater than 0.35 mm, and still more preferably equal to or greater than 0.4 mm.

In the embodiment, a part of the inner surface of the second hole part 20 is flush with the inner surface of the first hole part 18. The flush portion is the non-engagement corresponding surface 80. When the difference (K1−c1) is excessively large in the design of the hole 16, the size F1 and/or the size G1 are/is apt to be increased. In this case, the holding force to the weight body 12 is decreased. In this respect, the difference (K1−c1) is preferably equal to or less than 0.6 mm, more preferably equal to or less than 0.55 mm, and still more preferably equal to or less than 0.5 mm.

[H1/d1]

When a ratio (H1/d1) is excessively small, the size G1 and/or the size F1 is also apt to be small. In this case, the scraping of the inner surface of the second hole part 20 is apt to be caused. In this respect, the ratio (H1/d1) is preferably equal to or greater than 0.785, more preferably equal to or greater than 0.810, and still more preferably equal to or greater than 0.840.

When the torque is too strong in the transition to the engaging position EP from the non-engaging position NP, the excessive rotation of the weight body 12 may be caused. The weight body 12 may pass through the engaging position EP, and lead to the non-engaging position NP by the excessive rotation although the transition to the engaging position EP is intended. The excessive rotation of the weight body 12 is suppressed by decreasing the size H1. In respect of suppressing the excessive rotation, the ratio (H1/d1) is preferably equal to or less than 0.915, more preferably equal to or less than 0.890, and still more preferably equal to or less than 0.870.

Under an environment of 40° C., a maximum torque (N·m) required in attaching/detaching is defined as T40. Under an environment of 25° C., the maximum torque (N·m) required in attaching/detaching is defined as T25. Under an environment of 5° C., the maximum torque (N·m) required in attaching/detaching is defined as T5. In respect of enabling smooth attachment/detachment regardless of a temperature, a ratio (T40/T5) is preferably equal to or greater than 0.30, more preferably equal to or greater than 0.35, still more preferably equal to or greater than 0.40, and yet still more preferably equal to or greater than 0.41.

In respect of enabling smooth attachment/detachment regardless of a temperature, a ratio (T25/T5) is preferably equal to or greater than 0.57, more preferably equal to or greater than 0.60, and still more preferably equal to or greater than 0.61. As described above, a ratio (T25/T5) is considered to be equal to or less than 1 as in the ratio (T40/T5).

In respect of enabling smooth attachment/detachment at a low temperature, the maximum torque T5 is preferably equal or less than 6.3 (N·m), more preferably equal or less than 6.0 (N·m), still more preferably equal or less than 5.5 (N·m), and yet still more preferably equal or less than 5.0 (N·m).

In respect of ensuring fixation at a high temperature, the maximum torque T40 is preferably equal to or greater than 1.0 (N·m), more preferably equal to or greater than 1.5 (N·m), and still more preferably equal to or greater than 1.8 (N·m).

EXAMPLES

Hereinafter, the effects of the present invention will be clarified by examples. However, the present invention should not be interpreted in a limited way based on the description of the examples.

[Production of Head Body]

A hollow head body was produced by using a maraging steel. The head body was obtained by welding a face member and a body member. The face member was obtained by subjecting a rolling material to press process. The body member was obtained by lost-wax precision casting. "CUSTOM450" (trade name) manufactured by Carpenter Technology Corporation was used as the material of the body member. A recess was formed in the head body. The recess was formed so as to correspond to each socket. The inner diameter of the recess was substantially made the same as the outer diameter B3 of the socket. The recess was formed in the back of the sole. Only one recess was formed. This head was a fairway wood. In the head, a real loft angle was set to 15 degrees; a head volume was set to 150 cc; and a head maximum thickness Th was set to 35.5 mm. The size of the recess was adjusted so as to correspond to each test which will be described later.

[Production of Socket]

A socket having a shape shown in FIG. 12 was produced. The socket was obtained by injection molding. A thermoplastic polyurethane elastomer was used as the material of the socket. One or more selected from the group consisting of "Elastollan 1164D", "Elastollan 1198A", "Elastollan 1174D", and "Elastollan 1154D" were used as the thermoplastic polyurethane elastomer. These elastomers were blended if needed in order to adjust the hardness Hs of the socket. For the forming condition, a cool time was set to 50 seconds, and a pressure was set to 22%.

[Production of Weight Body]

A tungsten nickel alloy (W—Ni alloy) was used as the material of a weight body. The W—Ni alloy was formed by powder sintering to obtain the weight body.

"DP460" (trade name) manufactured by Sumitomo 3M Ltd. was used to bond the recess of the head body and the socket.

[Test 1]

Test 1 is overall evaluation including the results of test 2 and test 3 which will be described later. Evaluation results of 64 kinds of socket samples are shown in a matrix of eight rows by eight columns in Table 1. For example, in the socket sample located on the leftmost side and on the uppermost side in the matrix, a thickness B2 of an interposition part is 0.2 mm, the outer diameter B3 of the socket is 10 mm, and the evaluation of the socket sample is "1".

In these 64 kinds of sockets, a full length S1 was set constant.

The 64 kinds of sockets were evaluated. In the evaluation, five-stage evaluation was made on a scale of one to five. As the score is higher, the evaluation is higher. The following points were comprehensively evaluated in the evaluation:

(1a) easiness of design and manufacture of the weight body;

(1b) an adhesion area between the socket and the recess (a surface area of the socket);

(1c) a degree of freedom in design of the head; and (1d) formability of the socket.

The evaluations of these 64 kinds of socket samples are shown in Table 1.

[Test 2]

Specifications and evaluation results of test 2 are shown in the following Table 2. Samples 2-1 to 2-8 of the sockets were produced. In these samples, the thickness B2 of the interposition part was changed. In order to change the thickness B2 of the interposition part, the outer diameter B3 was also changed. The samples were evaluated. In the evaluation, five-stage evaluation was made on a scale of one to five. As the score is higher, the evaluation is higher. Evaluation items were as follows:

(2a) a weight of the socket;

(2b) formability of the interposition part; and (2c) durability of the interposition part.

The total of these three kinds of evaluation scores is shown as "overall score" in Table 2.

For the evaluation item (2a), as the socket is lighter, the evaluation is higher. As the socket is lighter, a degree of freedom in weight setting in the weight body and the head is higher, which facilitates design of a position of a center of gravity. For the evaluation item (2b), as the interposition part was thinner, the formability was decreased.

[Test 3]

Specifications and evaluation results of test 3 are shown in the following Table 3. Samples 3-1 to 3-8 of the sockets were produced. In these samples, the outer diameter B3 of the socket was changed. The thickness B2 of the interposition part was set constant. The samples were evaluated. In the evaluation, five-stage evaluation was made on a scale of one to five. As the score is higher, the evaluation is higher. Evaluation items were as follows:

(3a) a weight of the socket;

(3b) formability of the socket;

(3c) an adhesion area between the socket and the head body (an area of the outer surface of the socket);

(3d) formability of a recess of a head body h1; and (3e) a degree of freedom in design of a weight W1 of the weight body.

The total of these five kinds of evaluation scores is shown as "overall score" in Table 3.

For the evaluation (3d), it was found that if the inner diameter of the recess of the head body h1 is excessively large, a molten metal flow is poor, which is apt to cause defective casting. The defective casting was mainly generation of air holes (cavity). It was more difficult to form a cylindrical recess in the sole which was a curved surface as the diameter of the recess was increased.

[Test 4]

Specifications and evaluation results of test 4 are shown in the following Table 4. Samples 4-1 to 4-8 of the sockets were produced. In these samples, a length B1 in an insertion direction of the interposition part was changed. In the head of test 4, a length Y1 in an insertion direction between the starting point of the interposition part and the opening edge of the recess (see FIG. 12) was set to 3.35 mm. A length Y2 in an insertion direction between the end face of the weight body and the opening edge of the recess (see FIG. 12) was set to 0.5 mm. The samples were evaluated. In the evaluation, five-stage evaluation was made on a scale of one to five. As the score is higher, the evaluation is higher. Evaluation items were as follows:

(4a) adhesion of a foreign matter;

(4b) sounding;

(4c) a degree of freedom in design of the recess;

(4d) a weight of the socket;

(4e) appearance; and (4f) an adhesion area between the socket and the recess (a surface area of the socket).

The total of these six kinds of evaluation scores is shown as "overall score" in Table 4.

The evaluation (4a) and the evaluation (4b) were performed using a golf club. The sample socket was bonded to the recess of the head body to produce a head. The weight body was attached to the socket, and a golf club was produced using the head. A ball placed on a grass was actually hit using the golf club to evaluate the golf club.

Since it is more necessary to deepen the recess as the length B1 is longer for the evaluation (4d), the degree of freedom in design of the recess is decreased. The deep recess has a design barrier in the head having a small head maximum thickness Th.

[Test 5]

Specifications and evaluation results of test 5 are shown in the following Table 5. Samples 5-1 to 5-6 of the sockets were produced. In these samples, a full length S1 in an insertion direction of the socket was changed. The samples were evaluated. In the evaluation, five-stage evaluation was made on a scale of one to five. As the score is higher, the evaluation is higher. Evaluation items were as follows:

(5a) a height of a center of gravity of the head;

(5b) a weight of the socket;

(5c) an adhesion area between the socket and the head body (an area of the outer surface of the socket);

(5d) a degree of freedom in design of the recess; and (5e) a degree of freedom in design of a weight W1 of the weight body.

The total of these five kinds of evaluation scores is shown as "overall score" in Table 5.

For the evaluation (5a), as the full length S1 is longer, the recess is deeper, and the center of gravity of the head is apt to be higher. The full length S1 is preferably shorter in order to lower the center of gravity of the head. In this respect, as the full length S1 is shorter, the evaluation of the item (5a) is higher.

[Test 6]

Specifications and evaluation results of test 6 are shown in the following Table 6. Samples 6-1 to 6-8 of the sockets were produced. In these samples, a hardness Hs of the socket was changed. The samples were evaluated. In the evaluation, five-stage evaluation was made on a scale of one to five. As the score is higher, the evaluation is higher. Evaluation items were as follows:

(6a) fixing stability; and (6b) wear resistance.

The total of these two kinds of evaluation scores is shown as "overall score" in Table 5.

For the evaluation (6b), as the hardness Hs of the socket is smaller, wear caused by a mutual transition of a non-engaging position NP and an engaging position EP is suppressed. Therefore, as the hardness Hs of the socket is smaller, the evaluation of the item (6b) is higher.

[Test 7]

Specifications and evaluation results of test 7 are shown in the following Table 7. Samples 7-1 to 7-8 of golf clubs were produced. In these samples, the length B1 in the insertion direction of the interposition part was changed. The samples were evaluated. In the evaluation, five-stage evaluation was made on a scale of one to five. As the score is higher, the evaluation is higher. An evaluation item was vibration absorbing performance.

In this test 7, the same weight body was attached to all the samples. A clearance distance X1 between the head part of the weight body and the recess (see FIG. 12) was made the same as the thickness B2 of the interposition part.

The vibration absorbing performance was evaluated by a golf club. The evaluation is sensuous evaluation. A sample socket was bonded to the recess of the head body to produce a head. The weight body was attached to the socket. The golf club was produced using the head. "Miyazaki Kusala" (trade name) manufactured by Dunlop Sports Co., Ltd. was used as a shaft. A ball placed on grass was actually hit using the golf club to evaluate the golf club. Ten golf players having a handicap of equal to or less than 10 hit the balls to evaluate the vibration absorbing performance. The average scores of the evaluation scores of the ten golf players (the figures below the decimal point are rounded off) are shown in Table 7.

[Test 8]

Specifications and evaluation results of test 8 are shown in the following Table 8. Samples 8-1 to 8-8 of golf clubs were produced. In these samples, the thickness B2 of the interposition part was changed. The samples were evaluated. In the evaluation, five-stage evaluation was made on a scale of one to five. As the score is higher, the evaluation is higher. An evaluation item was vibration absorbing performance.

In the test 8, the clearance distance X1 and the thickness B2 of the interposition part were made the same by adjusting the diameter of the head part of the weight body. The difference between the weights of the head parts was canceled by the volume of the space r1, to set the weight W1 of the weight body constant. The weight bodies having a common outer shape except for the diameter of the head part were used. The thickness B2 was changed with the outer diameter B3 of the socket fixed.

The vibration absorbing performance was evaluated by a golf club. The evaluation is sensuous evaluation. A sample socket was bonded to the recess of the head body to produce a head. The weight body was attached to the socket. The golf club was produced using the head. The same shaft as that of the test 7 was used. A ball placed on grass was actually hit using the golf club to evaluate the golf club. The ten golf players hit the balls to evaluate the vibration absorbing performance. The average scores of the evaluation scores of the ten golf players (the figures below the decimal point are rounded off) are shown in Table 8.

TABLE 1

Specifications and evaluation results of test 1 (evaluation on thickness B2 and outer diameter B3)

| | | Thickness B2 (mm) | | | | | | | |
|---|---|---|---|---|---|---|---|---|---|
| | | 0.2 | 0.4 | 0.5 | 0.6 | 0.8 | 0.9 | 1 | 1.2 |
| Outer diameter B3 (mm) | 10 | 1 | 2 | 2 | 3 | 3 | 2 | 2 | 1 |
| | 13 | 2 | 3 | 3 | 4 | 4 | 3 | 3 | 2 |
| | 13.5 | 2 | 3 | 3 | 4 | 4 | 3 | 3 | 2 |
| | 14 | 3 | 4 | 4 | 5 | 5 | 4 | 4 | 3 |
| | 16 | 3 | 4 | 4 | 5 | 5 | 4 | 4 | 3 |
| | 16.5 | 2 | 3 | 3 | 4 | 4 | 3 | 3 | 2 |
| | 17 | 2 | 3 | 3 | 4 | 4 | 3 | 3 | 2 |
| | 20 | 1 | 2 | 2 | 3 | 3 | 2 | 2 | 1 |

TABLE 2

Specifications and evaluation results of test 2 (evaluation on thickness B2)

| | Sample 2-1 | Sample 2-2 | Sample 2-3 | Sample 2-4 | Sample 2-5 | Sample 2-6 | Sample 2-7 | Sample 2-8 |
|---|---|---|---|---|---|---|---|---|
| Thickness B2 (mm) | 0.2 | 0.4 | 0.5 | 0.6 | 0.8 | 0.9 | 1 | 1.2 |
| Weight of socket | 5 | 4 | 4 | 4 | 4 | 3 | 3 | 1 |
| Formability of interposition part | 1 | 3 | 3 | 4 | 4 | 4 | 4 | 5 |
| Durability of interposition part | 1 | 3 | 3 | 4 | 4 | 4 | 4 | 5 |
| Overall score | 7 | 10 | 10 | 12 | 12 | 11 | 11 | 11 |

TABLE 3

Specifications and evaluation results of test 3 (evaluation on outer diameter B3)

| | Sample 3-1 | Sample 3-2 | Sample 3-3 | Sample 3-4 | Sample 3-5 | Sample 3-6 | Sample 3-7 | Sample 3-8 |
|---|---|---|---|---|---|---|---|---|
| Outer diameter B3 (mm) | 10 | 13 | 13.5 | 14 | 16 | 16.5 | 17 | 20 |
| Weight of socket | 5 | 4 | 4 | 4 | 4 | 3 | 3 | 1 |
| Formability of socket | 5 | 4 | 4 | 4 | 4 | 3 | 3 | 1 |
| Adhesion area | 1 | 3 | 3 | 4 | 4 | 4 | 4 | 5 |
| Formability of recess | 5 | 4 | 4 | 4 | 4 | 3 | 3 | 1 |
| Degree of freedom of weight W1 of weight body | 1 | 3 | 3 | 4 | 4 | 4 | 4 | 5 |
| Overall score | 17 | 18 | 18 | 20 | 20 | 17 | 17 | 13 |

TABLE 4

Specifications and evaluation results of test 4 (evaluation on length B1)

| | Sample 4-1 | Sample 4-2 | Sample 4-3 | Sample 4-4 | Sample 4-5 | Sample 4-6 | Sample 4-7 | Sample 4-8 |
|---|---|---|---|---|---|---|---|---|
| Length B1 (mm) | 0 | 0.5 | 1 | 1.5 | 4 | 4.5 | 5 | 7 |
| Adhesion of foreign matter | 1 | 3 | 3 | 4 | 5 | 5 | 5 | 5 |
| Sounding (abnormal noise) | 1 | 3 | 3 | 4 | 5 | 5 | 5 | 5 |
| Degree of freedom in design of recess | 5 | 5 | 5 | 5 | 4 | 3 | 3 | 2 |
| Weight of socket | 5 | 4 | 4 | 4 | 3 | 3 | 3 | 2 |
| Appearance | 1 | 3 | 3 | 5 | 5 | 4 | 3 | 2 |
| Adhesion area | 1 | 3 | 3 | 3 | 4 | 4 | 4 | 5 |
| Overall score | 13 | 18 | 18 | 22 | 22 | 20 | 19 | 16 |

TABLE 5

Specifications and evaluation results of test 5 (evaluation on full length S1)

| | Sample 5-1 | Sample 5-2 | Sample 5-3 | Sample 5-4 | Sample 5-5 | Sample 5-6 |
|---|---|---|---|---|---|---|
| Full length S1 (mm) | 3 | 5 | 6 | 12 | 13 | 15 |
| Height of center of gravity | 5 | 4 | 4 | 3 | 3 | 1 |
| Weight of socket | 5 | 4 | 4 | 3 | 3 | 1 |
| Adhesion area | 0 | 3 | 4 | 5 | 5 | 5 |
| Degree of freedom in design of recess | 5 | 4 | 4 | 2 | 1 | 1 |
| Degree of freedom of weight W1 of weight body | 0 | 2 | 3 | 5 | 5 | 5 |
| Overall score | 15 | 17 | 19 | 18 | 17 | 13 |

TABLE 5-continued

Specifications and evaluation results of test 5 (evaluation on full length S1)

TABLE 6

Specifications and evaluation results of test 6 (evaluation on hardness Hs)

| | Sample 6-1 | Sample 6-2 | Sample 6-3 | Sample 6-4 | Sample 6-5 | Sample 6-6 | Sample 6-7 | Sample 6-8 |
|---|---|---|---|---|---|---|---|---|
| Hardness Hs (shore D) | 30 | 40 | 42 | 45 | 76 | 78 | 80 | 90 |
| Fxing force | 1 | 3 | 3 | 4 | 5 | 5 | 5 | 5 |
| Wear resistance | 5 | 4 | 4 | 4 | 3 | 2 | 2 | 1 |
| Overall score | 6 | 7 | 7 | 8 | 8 | 7 | 7 | 6 |

TABLE 7

| Secifications and evaluation results of test 7 (evaluation on vibration absorbing performance) | | | | | | | | |
|---|---|---|---|---|---|---|---|---|
| | Sample 7-1 | Sample 7-2 | Sample 7-3 | Sample 7-4 | Sample 7-5 | Sample 7-6 | Sample 7-7 | Sample 7-8 |
| Length B1 (mm) | 0 | 0.5 | 1 | 1.5 | 4 | 4.5 | 5 | 7 |
| Thickness B2 (mm) | 0.6 | 0.6 | 0.6 | 0.6 | 0.6 | 0.6 | 0.6 | 0.6 |
| Outer diameter B3 (mm) | 15 | 15 | 15 | 15 | 15 | 15 | 15 | 15 |
| Hardness Hs (shore D) | 53 | 53 | 53 | 53 | 53 | 53 | 53 | 53 |
| Full length S1 (mm) | 7.2 | 7.2 | 7.2 | 7.2 | 7.2 | 7.2 | 7.2 | 7.2 |
| Weight W1 of weight body (g) | 8 | 8 | 8 | 8 | 8 | 8 | 8 | 8 |
| Vibration absorbing performance | 1 | 2 | 2 | 4 | 5 | 5 | 5 | 5 |

TABLE 8

| Secifications and evaluation results of test 8 (evaluation on vibration absorbing performance) | | | | | | | | |
|---|---|---|---|---|---|---|---|---|
| | Sample 8-1 | Sample 8-2 | Sample 8-3 | Sample 8-4 | Sample 8-5 | Sample 8-6 | Sample 8-7 | Sample 8-8 |
| Length B1 (mm) | 4 | 4 | 4 | 4 | 4 | 4 | 4 | 4 |
| Thickness B2 (mm) | 0.2 | 0.4 | 0.5 | 0.6 | 0.8 | 0.9 | 1 | 1.2 |
| Outer diameter B3 (mm) | 15 | 15 | 15 | 15 | 15 | 15 | 15 | 15 |
| Hardness Hs (shore D) | 53 | 53 | 53 | 53 | 53 | 53 | 53 | 53 |
| Full length S1 (mm) | 7.2 | 7.2 | 7.2 | 7.2 | 7.2 | 7.2 | 7.2 | 7.2 |
| Weight W1 of weight body (g) | 8 | 8 | 8 | 8 | 8 | 8 | 8 | 8 |
| Vibration absorbing performance | 2 | 3 | 3 | 4 | 4 | 4 | 5 | 5 |

As shown in Tables 1 to 8, the advantages of the present invention are apparent.

The present invention described above can be applied to all golf clubs. The present invention can be used for a wood type club, a utility type club, a hybrid type club, an iron type club, and a putter club or the like.

The description hereinabove is merely for an illustrative example, and various modifications can be made in the scope not to depart from the principles of the present invention.

What is claimed is:

1. A golf club head comprising:

a head body having a sole;

an opening part formed in the sole and opened to the outside;

a socket permanently fixed to the opening part; and a weight body capable of being attached/detached to/from the socket, wherein the weight body can be attached/detached by relative rotation of an angle θ to the socket;

the weight body has an engaging part and an exposed part;

the weight body includes a metal;

the socket has a first hole part, a second hole part, and an interposition part;

the socket includes a polymer;

the engaging part can take an engaging position EP and a non-engaging position NP in the second hole part by the relative rotation of the angle θ;

the interposition part is interposed in at least a part between the exposed part and the head body in an attached state where the engaging part is placed at the engaging position EP;

the exposed part is exposed to the outside in the attached state; and the interposition part does not fix the weight body.

2. The golf club head according to claim 1, wherein a length B1 in an insertion direction of the interposition part is 0.5 mm or greater and 5 mm or less;

a full length S1 in an insertion direction of the socket is 5 mm or greater and 13 mm or less;

the interposition part does not protrude to the outside with respect to the weight body in the attached state; and the weight body does not protrude to the outside of the opening part in the attached state.

3. The golf club head according to claim 1, wherein a thickness B2 of the interposition part is 0.4 mm or greater and 1 mm or less; and an outer diameter B3 of the interposition part is 13 mm or greater and 17 mm or less.

4. The golf club head according to claim 1, wherein a material of the socket is an urethane-based polymer; and a hardness Hs of the socket is D40 or greater and D80 or less.

5. The golf club head according to claim 1, wherein a weight W1 of the weight body is 1 g or greater and 15 g or less.

6. The golf club head according to claim 1, wherein the head body further has a crown; and a shortest distance T1 between an inner surface of the crown and a bottom face of the socket in the attached state is 5 mm or greater and 15 mm or less.

7. The golf club head according to claim 1, wherein a head maximum thickness is 35 mm or greater and 70 mm or less.

8. The golf club head according to claim 1, wherein the second hole part has a resistance surface pressed by the engaging part in the middle of the relative rotation;

the plurality of resistance surfaces opposed to each other are provided; and if a distance between the resistance surfaces is defined as F1, and a longest sectional size of the engaging part is defined as d1, F1/d1 is 0.935 or greater and 0.965 or less.

9. The golf club head according to claim 1, wherein if both end points of a longest cross line of the engaging part are defined as p1; a cross length of the second hole part between positions with which the both end points p1 are brought into contact at the engaging position is defined as G1; and a longest sectional size of the engaging part is defined as d1, G1/d1 is 0.987 or greater and 0.996 or less.

10. The golf club head according to claim 1, wherein if a length of a shortest cross line of the second hole part is defined as H1, and a longest sectional size of the engaging part is defined as d1, H1/d1 is 0.785 or greater and 0.915 or less.

11. The golf club head according to claim 1, wherein if a maximum torque (N·m) required in attaching/detaching under an environment of 40° C. is defined as T40, and a maximum torque (N·m) required in attaching/detaching under an environment of 5° C. is defined as T5, T40/T5 is 0.30 or greater and 1 or less.

12. The golf club head according to claim 1, wherein if a maximum torque (N·m) required in attaching/detaching under an environment of 25° C. is defined as T25, and a maximum torque (N·m) required in attaching/detaching under an environment of 5° C. is defined as T5, T25/T5 is 0.57 or greater and 1 or less.

13. The golf club head according to claim 1, wherein if a maximum torque (N·m) required in attaching/detaching under an environment of 40° C. is defined as T40, and a maximum torque (N·m) required in attaching/detaching under an environment of 5° C. is defined as T5, T40 is equal to or greater than 1.0 (N·m), and T5 is equal to or less than 6.3 (N·m).

* * * * *